US012291957B2

(12) United States Patent
Ambade et al.

(10) Patent No.: US 12,291,957 B2
(45) Date of Patent: May 6, 2025

(54) FIELD PUMP EQUIPMENT SYSTEM

(71) Applicant: Schlumberger Technology Corporation, Sugar Land, TX (US)

(72) Inventors: Amey Ambade, Houston, TX (US); Praprut Songchitruksa, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/346,469

(22) Filed: Jul. 3, 2023

(65) Prior Publication Data

US 2024/0003242 A1 Jan. 4, 2024

Related U.S. Application Data

(60) Provisional application No. 63/358,189, filed on Jul. 4, 2022.

(51) Int. Cl.
*E21B 47/008* (2012.01)

(52) U.S. Cl.
CPC ..... *E21B 47/008* (2020.05); *E21B 2200/20* (2020.05); *E21B 2200/22* (2020.05)

(58) Field of Classification Search
CPC ..... E21B 2200/20; E21B 2200/22; E21B 47/008; G06N 7/01; G06N 20/00
See application file for complete search history.

(56) References Cited

U.S. PATENT DOCUMENTS

| | | | | |
|---|---|---|---|---|
| 2013/0268241 | A1 | 10/2013 | Das et al. | |
| 2019/0287005 | A1 | 9/2019 | Subramaniyan et al. | |
| 2019/0317488 | A1 | 10/2019 | Al-Maghlouth et al. | |
| 2020/0370423 | A1 | 11/2020 | Li et al. | |
| 2021/0087925 | A1* | 3/2021 | Heidari | G06N 20/00 |
| 2022/0012644 | A1 | 1/2022 | Clifton et al. | |
| 2022/0025753 | A1* | 1/2022 | Heidari | E21B 49/005 |

FOREIGN PATENT DOCUMENTS

| | | | | |
|---|---|---|---|---|
| CA | 2835505 C | * | 2/2020 | E21B 41/0092 |

* cited by examiner

*Primary Examiner* — Zakiya W Bates
(74) *Attorney, Agent, or Firm* — Aashish Y. Chawla; Jeffrey D. Frantz

(57) ABSTRACT

A method can include receiving input that includes time series data from pump equipment at a wellsite, where the wellsite includes a wellbore in contact with a fluid reservoir; processing the input using a first trained machine learning model as an anomaly detector to generate output; and processing the input and the output using a second trained machine learning model to predict a survival function for the pump equipment.

18 Claims, 20 Drawing Sheets

1100

FIELD PUMP EQUIPMENT SYSTEM

RELATED APPLICATIONS

This application claims priority to and the benefit of a US Provisional application having Ser. No. 63/358,189, filed 4 Jul. 2022, which is incorporated by reference herein in its entirety.

BACKGROUND

A reservoir can be a subsurface formation that can be characterized at least in part by its porosity and fluid permeability. As an example, a reservoir may be part of a basin such as a sedimentary basin. A basin can be a depression (e.g., caused by plate tectonic activity, subsidence, etc.) in which sediments accumulate. As an example, where hydrocarbon source rocks occur in combination with appropriate depth and duration of burial, a petroleum system may develop within a basin, which may form a reservoir that includes hydrocarbon fluids (e.g., oil, gas, etc.). Various operations may be performed in the field to access such hydrocarbon fluids and/or produce such hydrocarbon fluids. For example, consider equipment operations where equipment may be controlled to perform one or more operations.

SUMMARY

A method can include receiving input that includes time series data from pump equipment at a wellsite, where the wellsite includes a wellbore in contact with a fluid reservoir; processing the input using a first trained machine learning model as an anomaly detector to generate output; and processing the input and the output using a second trained machine learning model to predict a survival function for the pump equipment. A system can include a processor; memory accessible to the processor; and processor-executable instructions stored in the memory to instruct the system to: receive input that includes time series data from pump equipment at a wellsite, where the wellsite includes a wellbore in contact with a fluid reservoir; process the input using a first trained machine learning model as an anomaly detector to generate output; and process the input and the output using a second trained machine learning model to predict a survival function for the pump equipment. One or more computer-readable storage media can include processor-executable instructions to instruct a wellsite computing system to: receive input that includes time series data from pump equipment at a wellsite, where the wellsite includes a wellbore in contact with a fluid reservoir; process the input using a first trained machine learning model as an anomaly detector to generate output; and process the input and the output using a second trained machine learning model to predict a survival function for the pump equipment. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

This description is not to be taken in a limiting sense, but rather is made merely for the purpose of describing the general principles of the implementations. The scope of the described implementations should be ascertained with reference to the issued claims.

Figure 1:
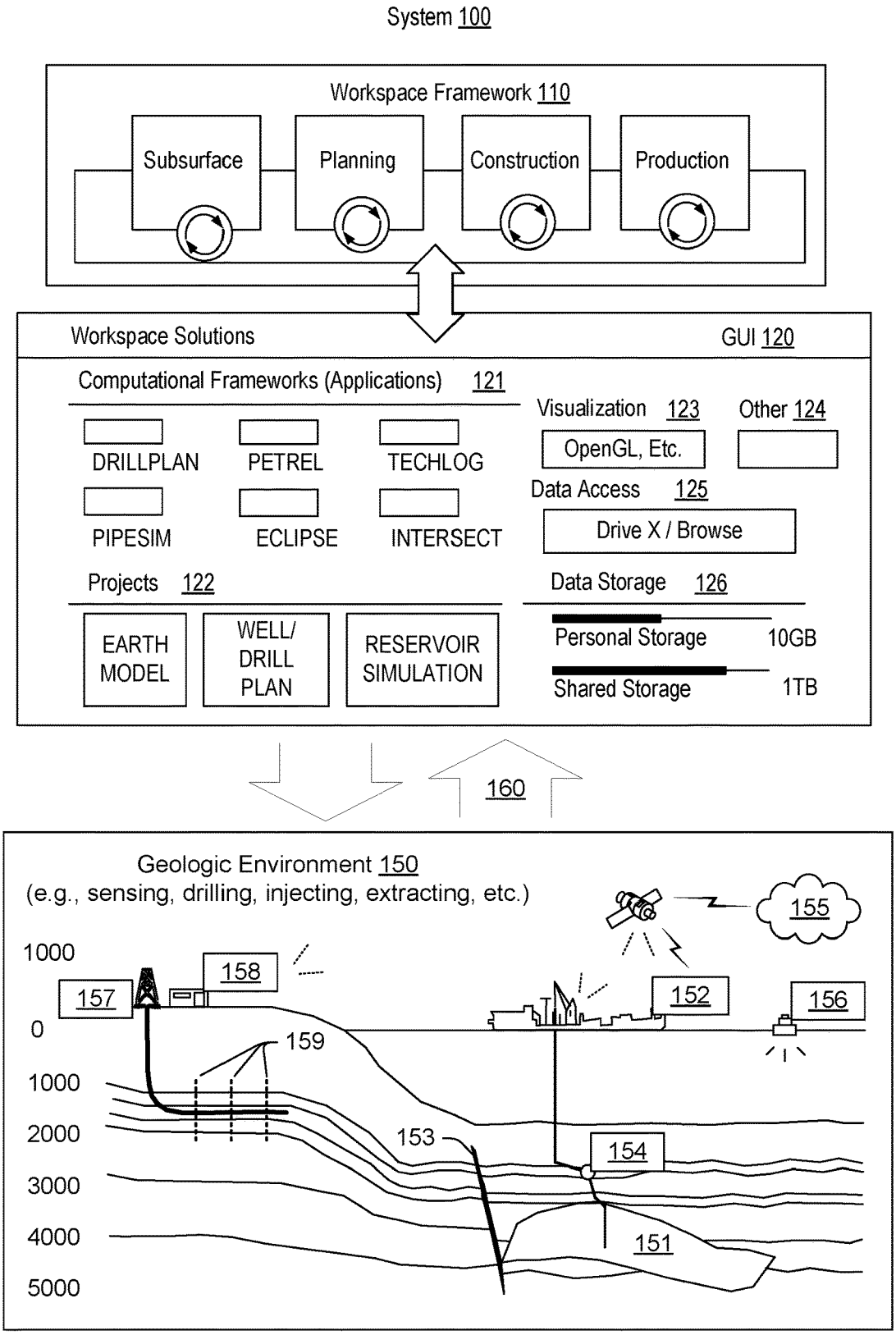
FIG. 1 illustrates an example system that includes various framework components associated with one or more geologic environments.

FIG. 1 shows an example of a system 100 that includes a workspace framework 110 that can provide for instantiation of, rendering of, interactions with, etc., a graphical user interface (GUI) 120. In the example of FIG. 1, the GUI 120 can include graphical controls for computational frameworks (e.g., applications) 121, projects 122, visualization 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. As an example, the geologic environment 150 may be outfitted with a variety of sensors, detectors, predictors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a wellsite and include sensing, detecting, predicting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows some examples of computational frameworks, including the DRILLPLAN, PETREL, TECHLOG, PETROMOD, ECLIPSE, and INTERSECT frameworks (SLB, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The PETREL framework can be part of the DELFI cognitive exploration and production (E&P) environment (SLB, Houston, Texas, referred to as the DELFI environment) for utilization in geosciences and geoengineering, for example, to analyze subsurface data from exploration to production of fluid from a reservoir.

One or more types of frameworks may be implemented within or in a manner operatively coupled to the DELFI environment, which is a secure, cognitive, cloud-based collaborative environment that integrates data and workflows with digital technologies, such as artificial intelligence (AI) and machine learning (ML). As an example, such an environment can provide for operations that involve one or more frameworks. The DELFI environment may be referred to as the DELFI framework, which may be a framework of frameworks. As an example, the DELFI environment can include various other frameworks, which can include, for example, one or more types of models (e.g., simulation models, etc.).

The TECHLOG framework can handle and process field and laboratory data for a variety of geologic environments (e.g., deepwater exploration, shale, etc.). The TECHLOG framework can structure wellbore data for analyses, planning, etc.

The PIPESIM simulator includes solvers that may provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (SLB, Houston Texas). As an example, a reservoir or reservoirs may be simulated with respect to one or more enhanced recovery techniques (e.g., consider a thermal process such as steam-assisted gravity drainage (SAGD), etc.). As an example, the PIPESIM simulator may be an optimizer that can optimize one or more operational scenarios at least in part via simulation of physical phenomena.

The ECLIPSE framework provides a reservoir simulator (e.g., as a computational framework) with numerical solutions for fast and accurate prediction of dynamic behavior for various types of reservoirs and development schemes.

The INTERSECT framework provides a high-resolution reservoir simulator for simulation of detailed geological features and quantification of uncertainties, for example, by creating accurate production scenarios and, with the integration of precise models of the surface facilities and field operations, the INTERSECT framework can produce reliable results, which may be continuously updated by real-time data exchanges (e.g., from one or more types of data acquisition equipment in the field that can acquire data during one or more types of field operations, etc.). The INTERSECT framework can provide completion configurations for complex wells where such configurations can be built in the field, can provide detailed chemical-enhanced-oil-recovery (EOR) formulations where such formulations can be implemented in the field, can analyze application of steam injection and other thermal EOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI cognitive E&P environment, for example, for rapid simulation of multiple concurrent cases. For example, a workflow may utilize one or more of the DELFI on demand reservoir simulation features.

The aforementioned DELFI environment provides various features for workflows as to subsurface analysis, planning, construction and production, for example, as illustrated in the workspace framework 110. As shown in FIG. 1, outputs from the workspace framework 110 can be utilized for directing, controlling, etc., one or more processes in the geologic environment 150 and, feedback 160, can be received via one or more interfaces in one or more forms (e.g., acquired data as to operational conditions, equipment conditions, environment conditions, etc.).

As an example, a workflow may progress to a geology and geophysics ("G&G") service provider, which may generate a well trajectory, which may involve execution of one or more G&G software packages.

In the example of FIG. 1, the visualization features 123 may be implemented via the workspace framework 110, for example, to perform tasks as associated with one or more of subsurface regions, planning operations, constructing wells and/or surface fluid networks, and producing from a reservoir.

As an example, a visualization process can implement one or more of various features that can be suitable for one or more web applications. For example, a template may involve use of the JAVASCRIPT object notation format (JSON) and/or one or more other languages/formats. As an example, a framework may include one or more converters. For example, consider a JSON to PYTHON converter and/or a PYTHON to JSON converter. In such an approach, one or more features of a framework that may be available in one language may be accessed via a converter. For example, consider the APACHE SPARK framework that can include features available in a particular language where a converter may convert code in another language to that particular language such that one or more of the features can be utilized. As an example, a production field may include various types of equipment, be operable with various frameworks, etc., where one or more languages may be utilized. In such an example, a converter may provide for feature flexibility and/or compatibility.

As an example, visualization features can provide for visualization of various earth models, properties, etc., in one or more dimensions. As an example, visualization features can provide for rendering of information in multiple dimensions, which may optionally include multiple resolution rendering. In such an example, information being rendered may be associated with one or more frameworks and/or one or more data stores. As an example, visualization features may include one or more control features for control of equipment, which can include, for example, field equipment that can perform one or more field operations. As an example, a workflow may utilize one or more frameworks to generate information that can be utilized to control one or more types of field equipment (e.g., drilling equipment, wireline equipment, fracturing equipment, etc.).

While several simulators are illustrated in the example of FIG. 1, one or more other simulators may be utilized, additionally or alternatively. For example, consider the VISAGE geomechanics simulator (SLB, Houston Texas) or the PETROMOD simulator (SLB, Houston Texas), etc. The VISAGE simulator includes finite element numerical solvers that may provide simulation results such as, for example, results as to compaction and subsidence of a geologic environment, well and completion integrity in a geologic environment, cap-rock and fault-seal integrity in a geologic environment, fracture behavior in a geologic environment, thermal recovery in a geologic environment, $CO_2$ disposal, etc. The PETROMOD framework provides petroleum systems modeling capabilities that can combine one or more of seismic, well, and geological information to model the evolution of a sedimentary basin. The PETROMOD framework can predict if, and how, a reservoir has been charged with hydrocarbons, including the source and timing of hydrocarbon generation, migration routes, quantities, and hydrocarbon type in the subsurface or at surface conditions. The MANGROVE simulator (SLB, Houston, Texas) provides for optimization of stimulation design (e.g., stimulation treatment operations such as hydraulic fracturing) in a reservoir-centric environment. The MANGROVE framework can combine scientific and experimental work to predict geomechanical propagation of hydraulic fractures, reactivation of natural fractures, etc., along with production forecasts within 3D reservoir models (e.g., production from a drainage area of a reservoir where fluid moves via one or more types of fractures to a well and/or from a well). The MANGROVE framework can provide results pertaining to heterogeneous interactions between hydraulic and natural fracture networks, which may assist with optimization of the number and location of fracture treatment stages (e.g., stimulation treatment(s)), for example, to increase perforation efficiency and recovery.

Figure 2:
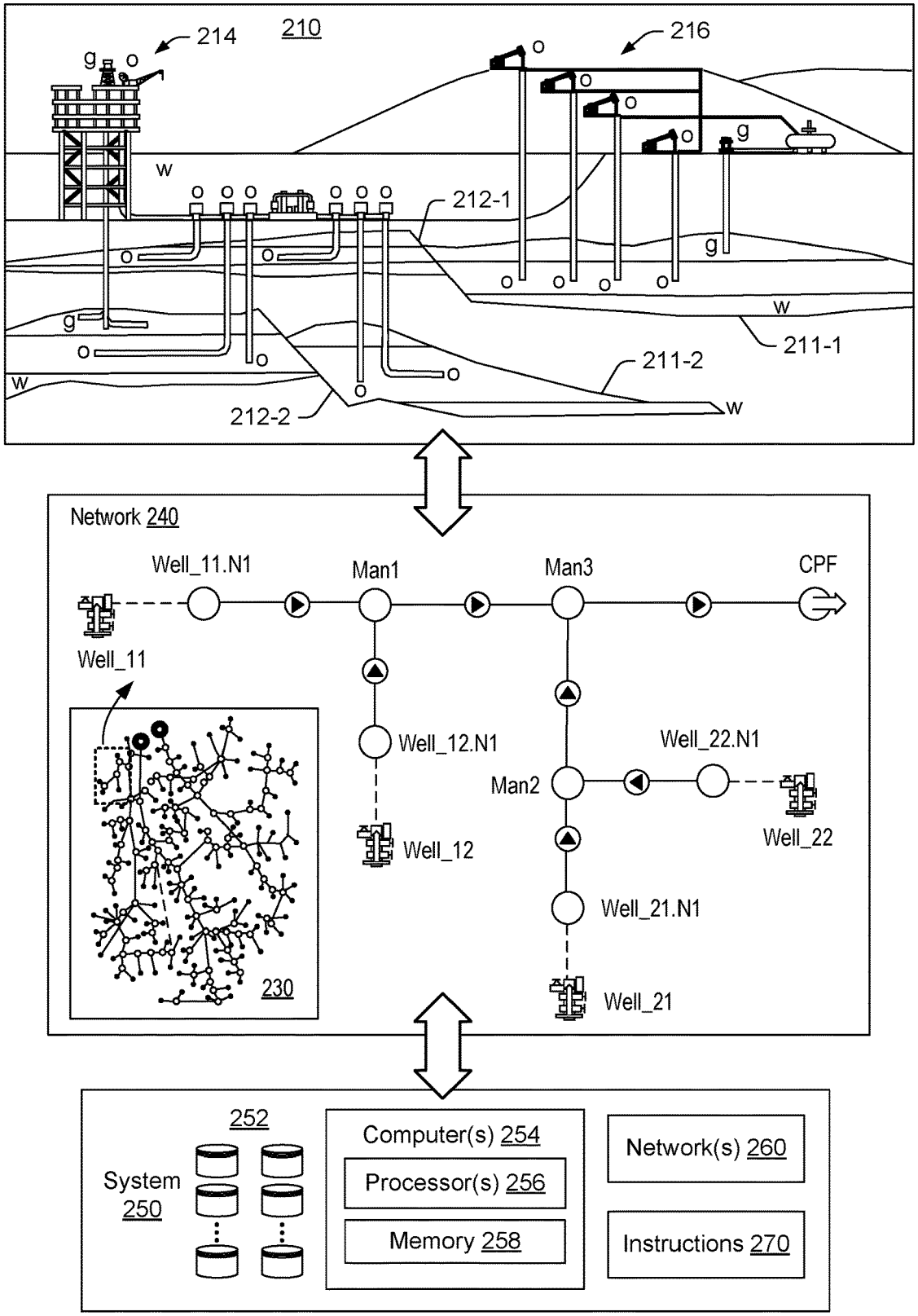
FIG. 2 illustrates examples of equipment, an example of a network and an example of a system.

FIG. 2 shows an example of a geologic environment 210 that includes reservoirs 211-1 and 211-2, which may be faulted by faults 212-1 and 212-2, an example of a network of equipment 230, an enlarged view of a portion of the network of equipment 230, referred to as network 240, and an example of a system 250. FIG. 2 shows some examples of offshore equipment 214 for oil and gas operations related to the reservoir 211-2 and onshore equipment 216 for oil and gas operations related to the reservoir 211-1. In the example of FIG. 2, the geologic environment 210 can include fluids such as oil (o), water (w) and gas (g), which may be stratified in the reservoirs 211-1 and 211-2.

In the example of FIG. 2, the equipment 214 and 216 can include one or more of drilling equipment, wireline equipment, production equipment, etc. For example, consider the equipment 214 as including a drilling rig that can drill into a formation to reach a reservoir target where a well can be completed for production of hydrocarbons. As an example, the equipment 216 can include production equipment such as wellheads, valves, pump equipment, gas handling equipment, etc. As an example, one or more features of the system 100 of FIG. 1 may be utilized for operations in the geologic environment 210. For example, consider utilizing a drilling or well plan framework, a drilling execution framework, a production framework, etc., to plan, execute, etc., one or more drilling operations, production operations, etc.

In FIG. 2, the network 240 can be an example of a relatively small production system network. As shown, the network 240 forms somewhat of a tree like structure where flowlines represent branches (e.g., segments) and junctions represent nodes. As shown in FIG. 2, the network 240 provides for transportation of fluid (e.g., oil, water and/or gas) from well locations along flowlines interconnected at junctions with final delivery at a central processing facility (CPF). Where fluid includes solids (e.g., sand, etc.), one or more pieces of equipment may provide for solids removal, collection, etc.

In the example of FIG. 2, various portions of the network 240 may include conduit. For example, consider a perspective view of a geologic environment that includes two conduits which may be a conduit to Man1 and a conduit to Man3 in the network 240, where Man1, Man2 and Man3 are manifolds. In the example of FIG. 2, various portions of the network 240 can include one or more pumps, which can include one or more surface and/or subsurface pumps.

As shown in FIG. 2, the example system 250 includes one or more information storage devices 252, one or more computers 254, one or more networks 260 and instructions 270 (e.g., organized as one or more sets of instructions). As to the one or more computers 254, each computer may include one or more processors (e.g., or processing cores) 256 and memory 258 for storing the instructions 270 (e.g., one or more sets of instructions), for example, executable by at least one of the one or more processors. As an example, a computer may include one or more network interfaces (e.g., wired or wireless), one or more graphics cards, a display interface (e.g., wired or wireless), etc. As an example, imagery such as surface imagery (e.g., satellite, geological, geophysical, etc.) may be stored, processed, communicated, etc. As an example, data may include SAR data, GPS data, etc. and may be stored, for example, in one or more of the storage devices 252. As an example, information that may be stored in one or more of the storage devices 252 may include information about equipment, location of equipment, orientation of equipment, fluid characteristics, etc.

As an example, the instructions 270 can include instructions (e.g., stored in the memory 258) executable by at least one of the one or more processors 256 to instruct the system 250 to perform various actions. As an example, the system 250 may be configured such that the instructions 270 provide for establishing a framework, for example, that can perform network modeling (see, e.g., the PIPESIM framework of the example of FIG. 1, etc.) and/or other modeling. As an example, one or more methods, techniques, etc. may be performed using one or more sets of instructions, which may be, for example, the instructions 270 of FIG. 2.

As an example, various graphics in FIG. 2 may be part of a graphical user interface (GUI) that can be generated using executable instructions that may be executable locally and/or remotely using local and/or remote display devices (e.g., a mobile device, a workstation, etc.).

Figure 3:
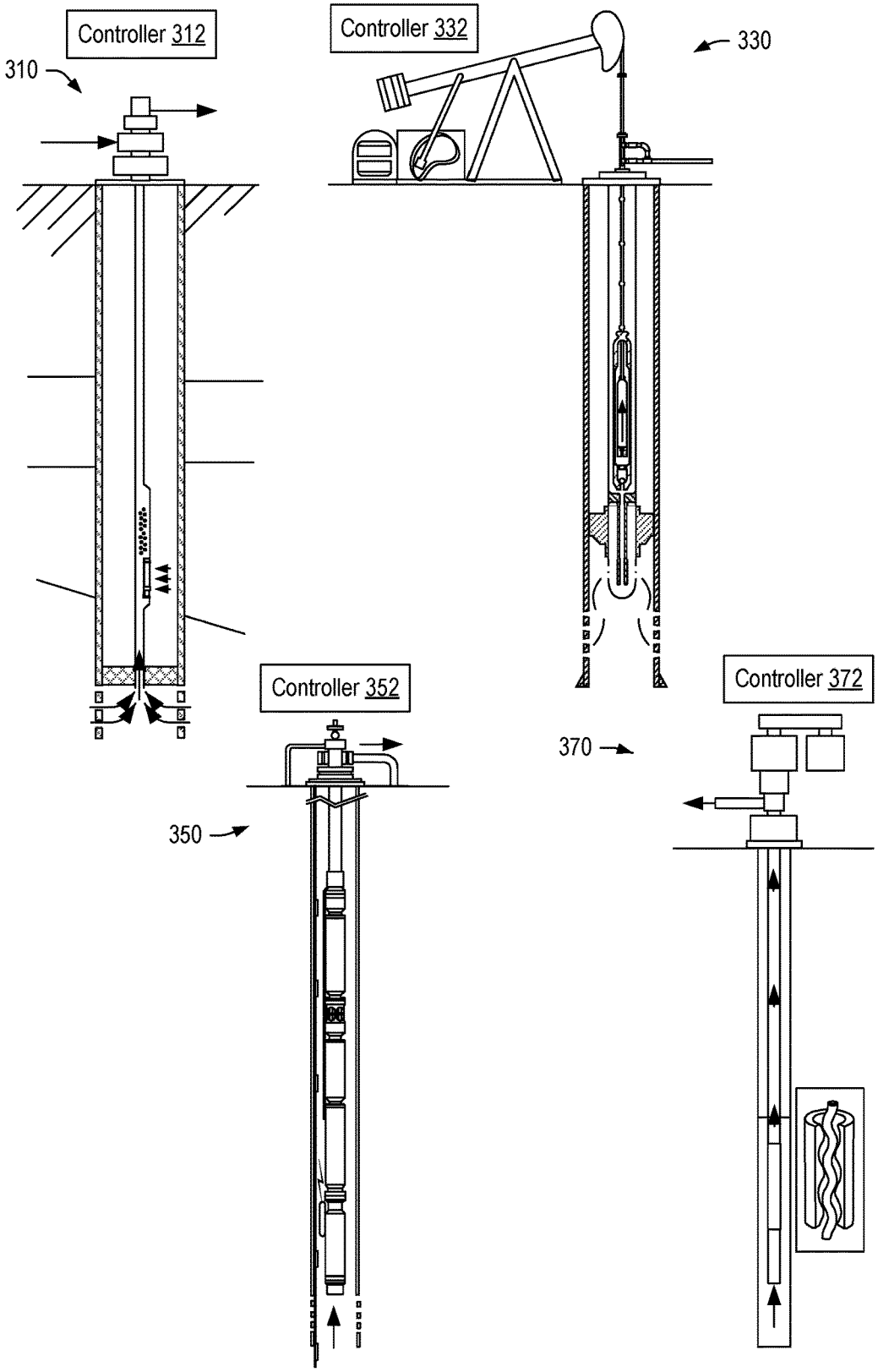
FIG. 3 illustrates example of equipment.

FIG. 3 shows examples of equipment 310, 330, 350 and 370 that can be utilized in the field to move fluid. As shown, the equipment 310 can include gas-lift equipment, the equipment 330 can include sucker rod pump equipment, the equipment 350 can include electric submersible pump (ESP) equipment, and the equipment 370 can include progressive cavity pump (PCP) equipment. As an example, a pump may be a compressor (e.g., a centrifugal compressor, a reciprocating compressor, etc.). As mentioned, the network 240 of FIG. 2 can include one or more pumps, which may include one or more of the types of equipment 310, 330, 350 and 370 and/or one or more other types of equipment.

In FIG. 3, the equipment 310, 330, 350 and 370 can be artificial lift equipment, where one or more controllers 312, 332, 352 and 372 can be included with the equipment 310, 330, 350 and 370 and/or operatively coupled to the equipment 310, 330, 350 and 370. In such an example, one or more features of the system 250 may be included in the one or more controllers 312, 332, 352 and 372 and/or operatively coupled to the one or more controllers 312, 332, 352 and 372.

Artificial lift equipment can add energy to a fluid column in a wellbore with the objective of initiating and/or improving production from a well. Artificial lift systems can utilize a range of operating principles (e.g., rod pumping, gas lift, electric submersible pumps, etc.). As such, artificial lift equipment can operate through utilization of one or more resources (e.g., fuel, electricity, gas, etc.).

Gas lift is an artificial-lift method in which gas is injected into production tubing to reduce hydrostatic pressure of a fluid column. The resulting reduction in bottomhole pressure allows reservoir liquids to enter a wellbore at a higher flow rate. In gas lift, injection gas can be conveyed down a tubing-casing annulus and enter a production train through a series of gas-lift valves. In such an approach, a gas-lift valve position, operating pressure and gas injection rate may be operational parameters (e.g., determined by specific well conditions, etc.).

A sucker rod pump is an artificial-lift pumping system that uses a surface power source to drive a downhole pump assembly. For example, a beam and crank assembly can create reciprocating motion in a sucker rod string that connects to a downhole pump assembly. In such an example, the pump can include a plunger and valve assembly to convert the reciprocating motion to vertical fluid movement. As an example, a sucker rod pump may be driven using electricity and/or fuel. For example, a prime mover of a sucker rod pump can be an electric motor or an internal combustion engine.

An ESP is an artificial-lift system that utilizes a downhole pumping system that is electrically driven. In such an example, the pump can include staged centrifugal pump sections that can be specifically configured to suit production and wellbore characteristics of a given application. ESP systems may provide flexibility over a range of sizes and output flow capacities.

A PCP is a type of a sucker rod-pumping unit that uses a rotor and a stator. In such an approach, rotation of a rod by means of an electric motor at surface causes fluid contained in a cavity to flow upward. A PCP may be referred to as a rotary positive-displacement unit.

A compressor can be a mechanical device that is used to increase pressure of a compressible fluid (e.g., gas, vapor, etc.). A compressor can increase fluid pressure and reduce fluid volume to assist with fluid transport. Compressors find use in the oil and gas industry for applications such as, for example, gas lift, fluid gathering, processing operations of fluid, transmission and distribution systems, reinjection of fluid (e.g., for pressure maintenance, etc.), reduction of fluid volume for storage or shipment by tankers, etc.

In the examples of FIG. 3, one or more sensors may be included. For example, consider a gauge coupled to a downhole end of an ESP where signals from sensors of the gauge can be transmitted to surface equipment using a power cable and/or a dedicated gauge cable. For example, consider the PHOENIX gauge (SLB, Houston, Texas), which include sensors that can measure intake pressure, temperature, motor oil temperature, winding temperature, vibration, current leakage and/or pump discharge pressure. A gauge may be operatively coupled to a controller, which may, for example, provide controls for backspin of an ESP, sanding of an ESP, flux of an ESP and gas related issues of an ESP. For example, during operation where sand is present (e.g., suspended solid matter, etc.), sand may accumulate in one or more stages of an ESP where a control scheme may act to rid the ESP of at least a portion of the sand.

As an example, a PCP may be suitable for use in production for wells characterized by highly viscous fluid and high sand cut where the PCP has some sand-lifting capability. However, sand may accumulate where a control scheme may be utilized to rid the PCP of at least a portion of the sand.

As an example, a sucker rod pump may be operable as a stroke-through pump to release sand and other material. In such an example, to minimize damage to a plunger and barrel, a grooved-body plunger may be used to catch and carry the sand away from those components.

As an example, gas lift equipment may be utilized in applications where abrasive materials, such as sand, may be present and can be used in low-productivity, high-gas/oil ratio-wells or deviated wellbores. As an example, gas lift equipment such as pocketed mandrels can utilize slickline-retrievable gas lift valves, which may be pulled and replaced without disturbing tubing.

As an example, equipment may include water flooding equipment. For example, consider an enhanced oil recovery (EOR) process in which a small amount of surfactant is added to an aqueous fluid injected to sweep a reservoir. In such an example, presence of surfactant reduces the interfacial tension between oil and water phases and may also alter wettability of reservoir rock (e.g., to improve oil recovery). In such an example, movement of fluid (e.g., oil and/or water) and/or presence of surfactant may carry particles of the reservoir rock to a production well or production wells where such particles (e.g., sand) can result in a sand event, whether one or more of the production well or wells include artificial lift equipment or not. As water flooding becomes more prevalent globally, an increase in sand related issues may be expected (e.g., sand influx into production wells).

As an example, equipment can include a choke or chokes, which can include a surface choke and/or a downhole choke. A choke is a device that includes an orifice that can be used to control flow of fluid through the orifice, for example, to control fluid flow rate, downstream system pressure, etc. Chokes are available in various configurations, which include fixed and adjustable chokes. An adjustable choke enables fluid flow and pressure parameters to be changed as desired (e.g., for process, production, etc.).

An adjustable choke includes a valve that can be adjusted to control well operations, for example, to reduce pressure of a fluid from high pressure in a closed wellbore to atmospheric pressure. An adjustable choke valve may be adjusted (e.g., fully opened, partially opened or closed) to control pressure drop. As an example, an adjustable choke may be manually adjustable or adjustable via a controller that may be integral to or operatively coupled to the adjustable choke. A controller for an adjustable choke may respond to locally generated and/or remotely generated signals.

A downhole choke or bottom hole choke can be a downhole device used to control fluid flow under downhole conditions. As an example, a downhole choke may be removable via slickline intervention where the downhole choke may be located in a landing nipple in a tubing string. In some scenarios, a downhole chock may be used as a flow regulator and to take part of the pressure drop downhole, which may help to reduce potential of hydrate issues.

Figure 4:
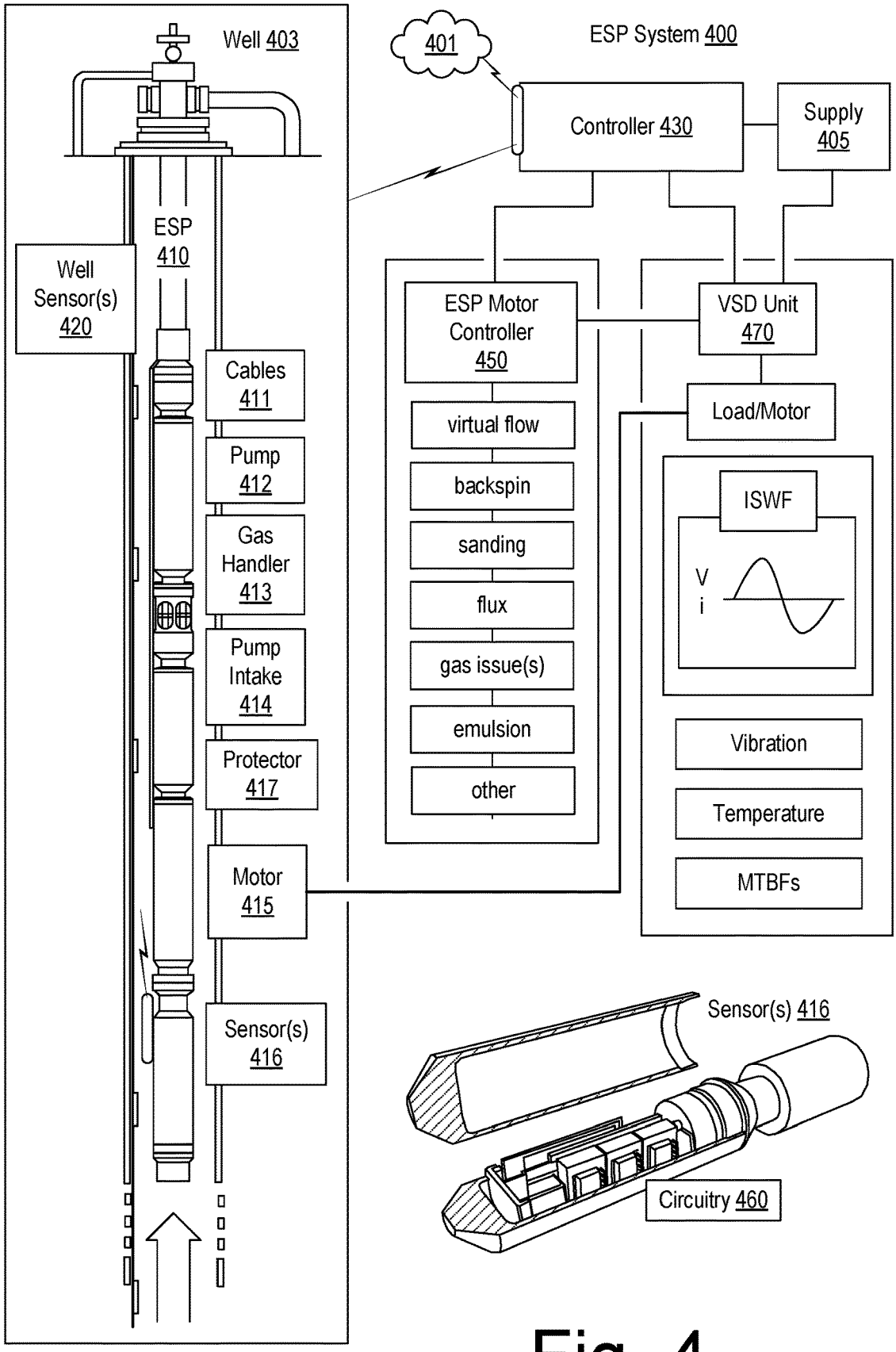
FIG. 4 illustrates an example of an electric submersible pump system.

FIG. 4 shows an example of an ESP system 400 that includes an ESP 410 as an example of equipment that may be placed in a geologic environment. As an example, an ESP may be expected to function in an environment over an extended period of time (e.g., optionally of the order of years).

In the example of FIG. 4, the ESP system 400 includes a network 401, a well 403 disposed in a geologic environment (e.g., with surface equipment, etc.), a power supply 405, the ESP 410, a controller 430, a motor controller 450 and a variable speed drive (VSD) unit 470 (e.g., a surface control unit). The power supply 405 may receive power from a power grid, an onsite generator (e.g., natural gas driven turbine), or other source. The power supply 405 may supply a voltage, for example, of about 4.16 kV.

As shown, the well 403 includes a wellhead that can include a choke (e.g., a choke valve). For example, the well 403 can include a choke valve to control various operations such as to reduce pressure of a fluid from high pressure in a closed wellbore to atmospheric pressure. A wellhead may include one or more sensors such as a temperature sensor, a pressure sensor, a solids sensor, etc. As an example, a wellhead can include a temperature sensor and a pressure sensor.

As to the ESP 410, it is shown as including cables 411 (e.g., or a cable), a pump 412, gas handling features 413, a pump intake 414, a motor 415, one or more sensors 416 (e.g., temperature, pressure, strain, current leakage, vibration, etc.) and a protector 417.

As an example, an ESP may include a REDA HOTLINE high-temperature ESP motor. As an example, an ESP motor can include a three-phase squirrel cage with two-pole induction. As an example, an ESP motor may include steel stator laminations that can help focus magnetic forces on rotors, for example, to help reduce energy loss. As an example, stator windings can include copper and insulation.

As an example, the one or more sensors 416 of the ESP 410 may be part of a digital downhole monitoring system. For example, consider the PHOENIX MULTISENSOR XT150 system (SLB, Houston, Texas). A monitoring system may include a base unit that operatively couples to an ESP motor (see, e.g., the motor 415), for example, directly, via a motor-base crossover, etc. As an example, such a base unit (e.g., base gauge) may measure intake pressure, intake temperature, motor oil temperature, motor winding temperature, vibration, current leakage, etc. As an example, a base unit may transmit information via a power cable that provides power to an ESP motor and may receive power via such a cable as well.

As shown in the example of FIG. 4, the one or more sensors 416 can include circuitry 460. As an example, such circuitry 460 can include one or more processors and memory that can store processor-executable instructions. As an example, such instructions can include instructions for one or more monitoring and/or control features. As an example, the circuitry 460 may be utilized as an edge device and/or as part of an edge device (see, e.g., FIG. 5).

As an example, a remote unit may be provided that may be located at a pump discharge (e.g., located at an end opposite the pump intake 414). As an example, a base unit and a remote unit may, in combination, measure intake and discharge pressures across a pump (see, e.g., the pump 412), for example, for analysis of a pump curve. As an example, alarms may be set for one or more parameters (e.g., measurements, parameters based on measurements, etc.).

Where a system includes a base unit and a remote unit, such as those of the PHOENIX MULTISENSOR XT150 system, the units may be linked via wires. Such an arrangement provide power from the base unit to the remote unit and allows for communication between the base unit and the remote unit (e.g., at least transmission of information from the remote unit to the base unit). As an example, a remote unit is powered via a wired interface to a base unit such that one or more sensors of the remote unit can sense physical phenomena. In such an example, the remote unit can then transmit sensed information to the base unit, which, in turn, may transmit such information to a surface unit via a power cable configured to provide power to an ESP motor.

In the example of FIG. 4, the well 403 may include one or more well sensors 420, for example, such as the OPTICLINE sensors or WELLWATCHER BRITEBLUE sensors (SLB, Houston, Texas). Such sensors are fiber-optic based and can provide for real time sensing of temperature, for example, in SAGD or other operations. As shown in the example of FIG. 1, a well can include a relatively horizontal portion. Such a portion may collect heated heavy oil responsive to steam injection. Measurements of temperature along the length of the well can provide for feedback, for example, to understand conditions downhole of an ESP. Well sensors may extend a considerable distance into a well and possibly beyond a position of an ESP.

In the example of FIG. 4, the controller 430 can include one or more interfaces, for example, for receipt, transmission or receipt and transmission of information with the motor controller 450, a VSD unit 470, the power supply 405 (e.g., a gas fueled turbine generator, a power company, etc.), the network 401, equipment in the well 403, equipment in another well, etc.

As an example, the controller 430 may include features of an ESP motor controller and optionally supplant the ESP motor controller 450. For example, the controller 430 may include features of the INSTRUCT motor controller (SLB, Houston, Texas) and/or features of the UNICONN motor controller (SLB, Houston, Texas), which may connect to a SCADA system, the ESPWATCHER surveillance system (SLB, Houston, Texas), the LIFTWATCHER system (SLB, Houston, Texas), LIFTIQ system (SLB, Houston, Texas), etc. The UNICONN motor controller and/or the INSTRUCT motor controller can perform some control and data acquisition tasks for ESPs, surface pumps or other monitored wells. As an example, a motor controller can interface with the aforementioned PHOENIX monitoring system, for example, to access pressure, temperature and vibration data and various protection parameters as well as to provide direct current power to downhole sensors. As an example, a motor controller can interface with fixed speed drive (FSD) controllers or a VSD unit, for example, such as the VSD unit 470.

For FSD controllers, a motor controller can monitor ESP system three-phase currents, three-phase surface voltage, supply voltage and frequency, ESP spinning frequency and leg ground, power factor and motor load. For VSD units, a motor controller can monitor VSD output current, ESP running current, VSD output voltage, supply voltage, VSD input and VSD output power, VSD output frequency, drive loading, motor load, three-phase ESP running current, three-phase VSD input or output voltage, ESP spinning frequency, and leg-ground.

In the example of FIG. 4, the ESP motor controller 450 includes various modules to handle, for example, virtual flow estimations, backspin of an ESP, sanding of an ESP, flux of an ESP, gas issues of an ESP, emulsion presence, emulsion formation, etc. The motor controller 450 may include any of a variety of features, additionally, alternatively, etc.

In the example of FIG. 4, the VSD unit 470 may be a low voltage drive (LVD) unit, a medium voltage drive (MVD) unit or other type of unit (e.g., a high voltage drive, which may provide a voltage in excess of about 4.16 kV). As an example, the VSD unit 470 may receive power with a voltage of about 4.16 kV and control a motor as a load with a voltage from about 0 V to about 4.16 kV. The VSD unit 470 may include control circuitry such as the SPEEDSTAR MVD control circuitry (SLB, Houston, Texas).

Figure 5:
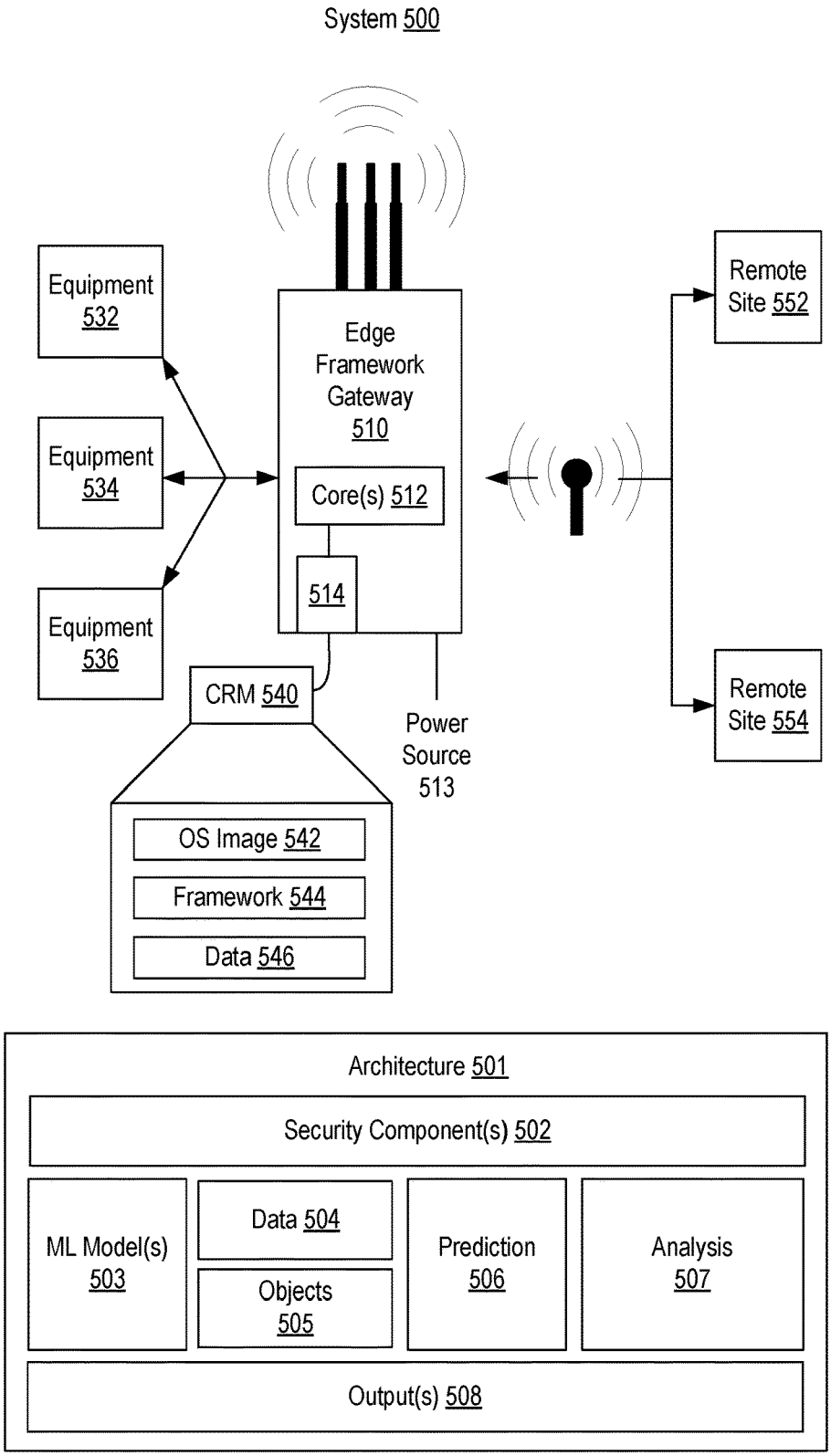
FIG. 5 illustrates an example of a system.

FIG. 5 shows an example of a system 500 and an example of an architecture 501 where the system 500 can include various local components that can be in communication with one or more remote components. As shown in the example of FIG. 5, the architecture 501 can provide for one or more security components 502, one or more machine learning models 503, data 504, objects 505, prediction techniques 506 (e.g., recognition, detection, prediction, etc.), analysis techniques 507 and output(s) 508. As an example, the system 500 may be operatively coupled to one or more pumps, which can include one or more ESPs. As an example, the system 500 may operate as a controller, a motor controller, etc., and/or provide information to a controller, a motor controller, etc.

As shown, the system 500 can include a power source 513 (e.g., solar, generator, batter, grid, etc.) that can provide power to an edge framework gateway 510 that can include one or more computing cores 512 and one or more media interfaces 514 that can, for example, receive a computer-readable medium 540 that may include one or more data structures such as an operating system (OS) image 542, a framework 544 and data 546. In such an example, the OS image 542 may cause one or more of the one or more cores 512 to establish an operating system environment that is suitable for execution of one or more applications. For example, the framework 544 may be an application suitable for execution in an established operating system in the edge framework gateway 510.

In the example of FIG. 5, the edge framework gateway 510 ("EF") can include one or more types of interfaces suitable for receipt and/or transmission of information. For example, consider one or more wireless interfaces that may provide for local communications at a site such as to one or more pieces of local equipment, which can include equipment 532, equipment 534 and equipment 536 and/or remote communications to one or more remote sites 552 and 554. In such an example, lesser or more equipment may be included.

As mentioned, the circuitry 460 of the one or more sensors 416 of the example of FIG. 4 can be utilized as an edge device and/or as part of an edge device. As an example, the circuitry 460 can include and/or host a framework such as the framework 544. As an example, the circuitry 460 can include and/or host containerized instructions (see, e.g., FIG. 13). As an example, the circuitry 460 may be operatively coupled to one or more pieces of surface equipment such as, for example, the edge framework gateway 510 of FIG. 5. As an example, an ESP may be equipped with its own edge computing resources that can, at least in part, operate downhole for monitoring and/or control of the ESP. In various examples, one or more downhole sensors may acquire one or more pressures, one or more temperatures, a drive frequency, etc., which may be inputs to one or more models, monitoring and/or control components, etc.

As an example, the equipment 532, 534 and 536 may include one or more types of equipment such as the equipment 310, the equipment 330, the equipment 350 and the equipment 370 of FIG. 3. As an example, equipment may include non-artificial lift equipment and/or artificial lift equipment.

As an example, the EF 510 may be installed at a site where the site is some distance from a city, a town, etc. In such an example, the EF 510 may be accessible via a satellite communication network and/or one or more other networks where data, control instructions, etc., may be transmitted, received, etc.

As an example, one or more pieces of equipment at a site may be controllable locally and/or remotely. For example, a local controller may be an edge framework-based controller that can issue control instructions to local equipment via a local network and a remote controller may be a cloud-based controller or other type of remote controller that can issue control instructions to local equipment via one or more networks that reach beyond the site. As an example, a site may include features for implementation of local and/or remote control. As an example, a controller may include an architecture such as a supervisory control and data acquisition (SCADA) architecture.

Satellite communication tends to be slower and more costly than other types of electronic communication due to factors such as distance, equipment, deployment and maintenance. For wellsites that do not have other forms of communication, satellite communication can be limiting in one or more aspects. For example, where a controller is to operate in real-time or near real-time, a cloud-based approach to control may introduce too much latency.

As shown in the example of FIG. 5, the EF 510 may be deployed where it can operate locally with the one or more pieces of equipment 532, 534 and 536, etc. As an example, the EF 510 may include switching and/or communication capabilities, for example, for information transmission between equipment, etc.

As desired, from time to time, communication may occur between the EF 510 and one or more remote sites 552, 554, etc., which may be via satellite communication where latency and costs are tolerable. As an example, the CRM 540 may be a removable drive that can be brought to a site via one or more modes of transport. For example, consider an air drop, a human via helicopter, plane, boat, etc.

As explained with respect to FIG. 5, an EF may execute within a gateway such as, for example, an AGORA gateway (e.g., consider one or more processors, memory, etc., which may be deployed as a "box" that can be locally powered and that can communicate locally with other equipment via one or more interfaces). As an example, one or more pieces of equipment may include computational resources that can be akin to those of an AGORA gateway or more or less than those of an AGORA gateway. As an example, an AGORA gateway may be a network device with various networking capabilities.

As an example, a gateway can include one or more features of an AGORA gateway (e.g., v.202, v.402, etc.) and/or another gateway. For example, consider features such as an INTEL ATOM E3930 or E3950 dual core with DRAM and an eMMC and/or SSD. Such a gateway may include a trusted platform module (TPM), which can provide for secure and measured boot support (e.g., via hashes, etc.). A gateway may include one or more interfaces (e.g., Ethernet, RS485/422, RS232, etc.). As to power, a gateway may consume less than about 100 W (e.g., consider less than 10 W or less than 20 W). As an example, a gateway may include an operating system (e.g., consider LINUX DEBIAN LTS or another operating system). As an example, a gateway may include a cellular interface (e.g., 4G LTE with global modem/GPS, 5G, etc.). As an example, a gateway may include a WIFI interface (e.g., 802.11 a/b/g/n). As an example, a gateway may be operable using AC 100-240 V, 50/60 Hz or 24 VDC. As to dimensions, consider a gateway that has a protective box with dimensions of approximately 10 in×8 in×4 in (e.g., 25 cm×20.3 cm×10.1 cm).

As an example, a gateway may be part of a drone. For example, consider a mobile gateway that can take off and land where it may land to operatively couple with equipment to thereby provide for control of such equipment. In such an example, the equipment may include a landing pad. For example, a drone may be directed to a landing pad where it can interact with equipment to control the equipment. As an example, a wellhead can include a landing pad where the wellhead can include one or more sensors (e.g., temperature and pressure) and where a mobile gateway can include features for generating fluid flow values using information from the one or more sensors. In such an example, the mobile gateway may issue one or more control instructions (e.g., to a choke, a pump, etc.).

As an example, a gateway itself may include one or more cameras such that the gateway can record conditions. For example, consider a motion detection camera that can detect the presence of an object. In such an example, an image of the object and/or an analysis (e.g., image recognition) signal thereof may be transmitted (e.g., via a satellite communication link) such that a risk may be assessed at a site that is distant from the gateway.

As an example, a gateway may include one or more accelerometers, gyroscopes, etc. As an example, a gateway may include circuitry that can perform seismic sensing that indicates ground movements. Such circuitry may be suitable for detecting and recording equipment movements and/or movement of the gateway itself.

As explained, a gateway can include features that enhance its operation at a remote site that may be distant from a city, a town, etc., such that travel to the site and/or communication with equipment at the site is problematic and/or costly. As explained, a gateway can include an operating system and memory that can store one or more types of applications that may be executable in an operating system environment. Such applications can include one or more security applications, one or more control applications, one or more simulation applications, etc.

As an example, various types of data may be available, for example, consider real-time data from equipment and ad hoc data. In various examples, data from sources connected to a gateway may be real-time, ad hoc data, sporadic data, etc. As an example, lab test data may be available that can be used to fine tune one or more models (e.g., locally, etc.). As an example, data from a framework such as the AVOCET framework may be utilized where results and/or data thereof can be sent to the edge. As an example, one or more types of ad hoc data may be stored in a database and sent to the edge.

As to real-time data, it can include data that are acquired via one or more sensors at a site and then transmitted after acquisition, for example, to a framework, which may be local, remote or part local and part remote. Such transmissions may be as streams (e.g., streaming data) and/or as batches. As to batches, a buffer may be utilized where an amount of data may be stored and then transmitted as a batch. In various instances, real-time data may be characterized using a sampling rate or sampling frequency. For example, consider 1 Hz as a sampling frequency that is adequate to track various types of physical phenomena that can occur during well operations. As an example, a sensor and/or a framework may provide for adjustment of sampling (e.g., at the sensor and/or at the framework). In various instances, data from multiple sensors may be at the same sampling rate or at one or more sampling rates.

As explained, various systems may operate in a local manner, optionally without access to a network such as the Internet. For example, a site may be relatively remote where satellite communication exists as a main mode of communication, which may be costly and/or low bandwidth. In such scenarios, security may resort to local features rather than a remote feature such as a remote authentication server.

An authentication server can provide a network service that applications use to authenticate credentials, which may be or include account names and passwords of users (e.g., human and/or machine). When a client submits a valid credential or credentials to an authentication server, the authentication server can generate a cryptographic ticket that the client can subsequently use to access one or more services.

In the example of FIG. 5, the edge framework 544 can be an edge-enabled data processing framework. As an example, such a framework can include features to perform one or more of the followings tasks: real-time data cleansing to synchronize information from existing well metrology (e.g., wellhead, tubing, flow, ESP, etc.); executing one or more machine learning (including self-learning) models in real-time (e.g., one or more ML models that can identify one or more issues, etc.); and conveying a control set point to a controller (e.g., an actuatable valve, etc.) and/or one or more other pieces of equipment. As mentioned, an edge framework may be deployable using downhole circuitry (see, e.g., the circuitry 460 of FIG. 4), which may be downhole circuitry operatively coupled to surface circuitry, etc.

The system 500 can be part of an infrastructure that serves as a secure gateway to transmit surveillance into an operator's surveillance station or its own surveillance platform. The presence of such a gateway can also support an operator for introduction of one or more additional IIOT (industrial internet of things) implementations.

As an example, one or more of the controllers of FIG. 3 and FIG. 4 may include or provide access to one or more frameworks, applications, etc. As an example, one or more of the controllers of FIG. 3 and FIG. 4 can include one or more features of the system 500 of FIG. 5.

As explained, an ESP can be implemented at a site for pumping fluid, whether for injection or production. For example, an ESP may be utilized in a stimulation treatment to inject fluid that includes various chemicals and an ESP may be utilized as an artificial lift technology to assist production of fluid from a reservoir.

As ESPs find various uses in various environments, knowledge as to operation, performance, etc., can be spread amongst various domains where each domain may have its own experts.

As an example, a system can provide for failure prediction and/or run-life estimation for one or more pumps for one or more purposes, which can include control and/or prognostic health monitoring (PHM).

Pump systems are prone to failures due to various reasons that may lead to substantial downtime and affect production. As an example, a method can include predicting, in advance, potential failures by using a sequence of complex ML models. In such an example, models can learn pump behavior during uptimes and provide a probability curve that can be used for issuance of one or more types of signals (e.g., alarms, control, etc.). For example, a signal can alert a controller and/or one or more operators when a precursor to a failure may be detected. Such run-life prediction can be observed over time along with appropriate thresholds to allow for preliminary active actions to be taken to mitigate failures.

As to ESPs, failures can be caused due to multiple reasons including operating conditions like pump wear, no flow, tubing leak, gas interference that may or may not exhibit predefined signal signatures. ESP failures may also be caused by abrupt and unexpected conditions such as startup and shutdown cycles that induce a lot of stress, and electrical failures which do not exhibit signatures. An ESP can be coupled to a cable, which can be of a substantial length (e.g., hundreds of meters, thousands of meters). A cable can include various conductors, insulation and strength members and may include armor or another material for protection. In various instances, a cable may support an ESP while in other instances an ESP may be supported in another manner. As explained, a cable can provide multiphase power for operation of an electric motor and, where fit with a gauge of one or more sensors, a cable can provide electrical power for operation of the gauge and for transmission of acquired sensor data. Various types of failures can be cable-related (e.g., ground faults, etc.).

As to an approach to failure detection, it may operate on a set of assumptions such as: a) specific behavior is exhibited by signals in the duration of a failure; b) consistency in the signatures for each failure event exists; and c) no variability in signatures exists (e.g., one signature for all failures). Furthermore, as such behavior is expected during a failure event, such an approach can be limited to, at best, detection of failure in real-time.

As mentioned, a system can provide for failure prediction. For example, consider a system that can provide for identifying and learning potential precursors to failure events using deep learning techniques and using them to predict pump failures using an ensemble approach.

Figure 6:
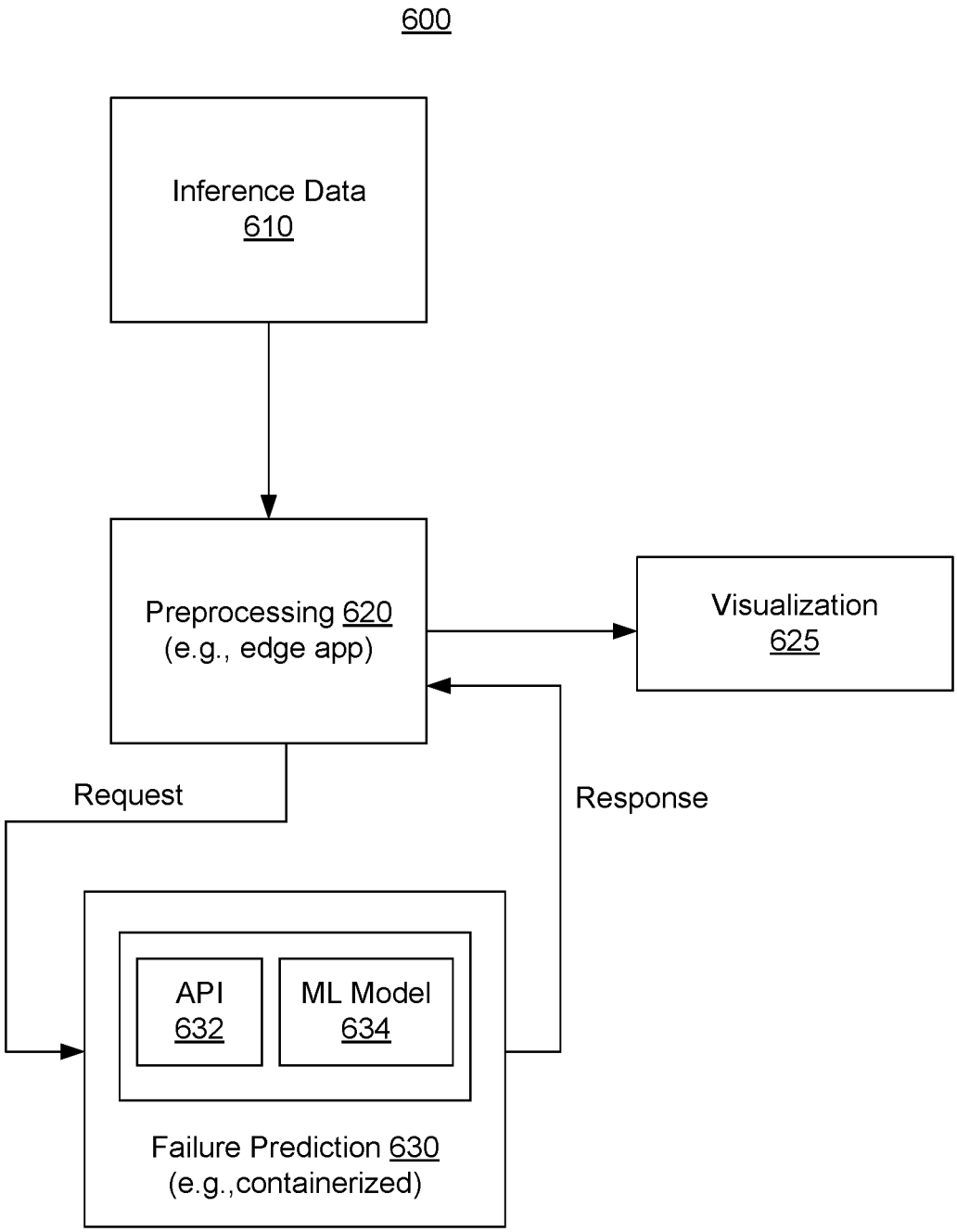
FIG. 6 illustrates an example of a system.

FIG. 6 shows an example of a system 600 that includes components for inference data acquisition 610, data preprocessing 620, optional data visualization 625, and failure prediction 630, which can be implemented using a containerized application programming interface (API) 632 for access to a trained ML model 634. As shown, an edge application architecture can be utilized where a suitable language or languages may be implemented (e.g., JSON, etc.). In the example of FIG. 6, the system 600 can preprocess data where API calls can be in the form of JSON requests where JSON responses can be received. In the example of FIG. 6, the system 600 can include one or more edge applications and one or more types of components (e.g., containerized, etc.) that may be accessed using one or more APIs.

Figure 7:
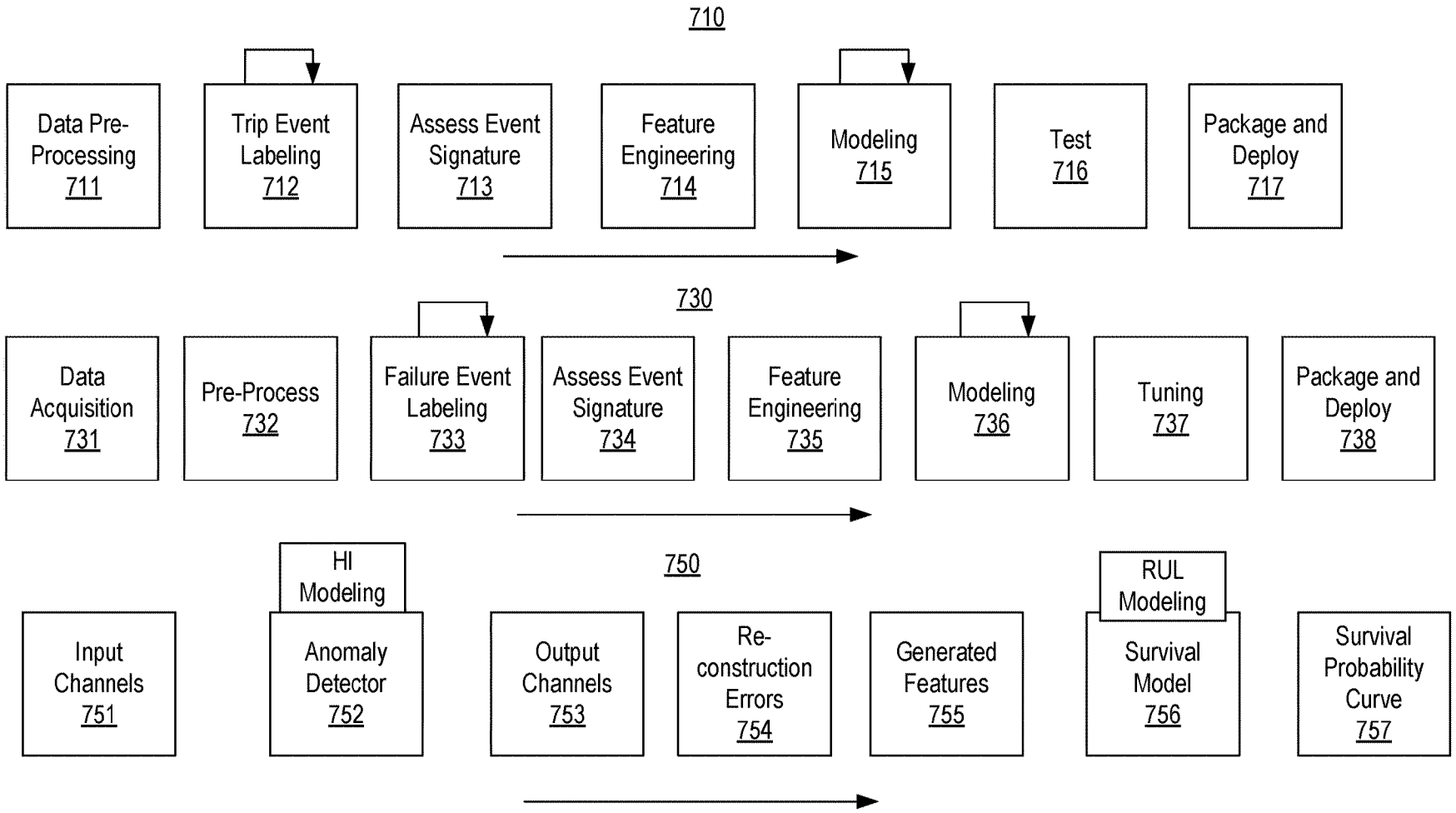
FIG. 7 illustrates examples of methods.

FIG. 7 shows examples of methods 710, 730 and 750. As shown, the method 710 can include a data pre-processing block 711, a trip event labeling block 712 that may utilize one or more subject matter experts (SMEs), an assessment block 713 for assessing event signatures, a feature engineering block 714 for determination of suitable features, a modeling block 715 that may be iterative, a test block 716 for testing a trained model of the modeling block 715, and a package and deployment block 717, which can provide for containerized packaging and deployment, for example, to an edge device.

As shown, the method 730 includes a data acquisition block 731 for acquisition of suitable frequency time series signal data like pressure, temperature, current, etc., which can be from one or more ESP systems (e.g., or one or more other pump systems); a pre-processing block 732 to handle outliers, inconsistencies, frequency and other quality control issues; and a failure event labeling block 733 that can utilize (SME) assistance, for example, such that data are labeled to mark start time and end time of failure events. In such an example, labeling can be binary, where 0 indicates no event and 1 indicates the presence of a failure event. Failure events may be identified by indicator signals like motor frequency, flat-lining, etc. As shown, the method 730 can further include an assessment block 734 for assessing event signatures, a feature engineering block 735 for feature engineering, a modeling block 736 for model generation, a model tuning block 737 and a package and deployment block 738.

In various regions in data before and after failure events, anomalous behavior regions can be identified. As an example, data can be split into regions of normal behavior and anomalous behavior, with an underlying assumption that failure precursors are absent in the regions of normal behavior. Such an approach provides for creating a dataset suitable for ML model training and testing such that a ML model can be trained for input of normal behavior data to replicate that normal behavior data. Such a trained ML model can be expected to be able to closely replicate input when a pump is behaving normally and to experience error when trying to replicate input when a pump is behaving abnormally because the ML model is not trained on data representative of anomalous behavior (e.g., abnormal behavior).

As to a reason for anomalous behavior, consider one or more physical phenomena as to sanding, gas entrainment, bearings, shaft(s), motor windings, electrical insulation, etc. For example, a reason may be equipment and/or environment based. Consider, as an example, sanding, which results from environmental sand that can cause increased stress on pump equipment, which may elevate temperature, increase wear on components, increase torque demand, decrease shaft stability, etc. As another example, consider temperature such as motor temperature, which may depend on flow rate, temperature of fluid flowing, energy utilized to drive the motor, etc. In such an example, relationships can exist between heat generation due to pumping and/or friction and heat removed due to flowing fluid. As an example, a system may provide for issuing commands to control pump equipment to address one or more issues (e.g., sanding, temperature, etc.).

As explained, pump equipment can include various components, which can be mechanical and/or electrical and which may be at surface and/or subsurface. As to an ESP, a cable can be a source of failure, for example, where shorting may occur due to stress, wear, etc. (e.g., noting that an ESP cable may be hundreds or thousands of meters in length). Referring again to FIG. 8, the various plots of the GUI 800 show some types of data that can be indicative of one or more types of anomalous events that may be detected using one or more types of ML models. As an example, a system such as, for example, the system 900 of FIG. 9 can include a control component that can operate using output of the component 920 and/or the component 930. For example, consider issuing one or more control instructions to pump equipment to reduce risk of encountering an event that may cause an undesirable reduction in run life of the pump equipment and/or that may help to address an emerging issue such as, for example, an increased level of sanding, an increase in motor temperature, etc.

As an example, an autoencoder ML model may be utilized that includes an encoder portion and a decoder portion. An autoencoder ML model can be described where the encoder portion maps input into code and where the decoder portion that maps the code to a reconstruction of the input. An autoencoder ML model can be a feedforward, non-recurrent neural network (e.g., akin to single layer perceptrons) that participate in multilayer perceptrons (MLP), for example, employing an input layer and an output layer connected by one or more hidden layers. An output layer can include the same number of nodes (neurons) as the input layer. As explained, an autoencoder ML model can reconstruct its inputs (e.g., by minimizing the difference between the input and the output) instead of predicting a target value Y given inputs X. As an example, an autoencoders ML model can be trained using unsupervised learning. As explained, data can be acquired and processed such that the data represent normal behavior of a pump (e.g., a pump system) where, once available, a ML model may be trained using such processed data in an unsupervised manner.

As explained, a ML model can emulate normal behavior where the ML model is built using an autoencoder-decoder model architecture. As explained, output of such a ML model can be expected to be the same as the input (e.g., original high-frequency signals). Such a ML model can be used to compute deviations in input signals by providing as input more complete time series data. For example, consider an approach that involves calculating absolute differences between input and output (e.g., reconstruction errors).

Through use of a trained ML model, reconstruction errors can be generated where higher errors can be an indicator of input indicative of anomalous behavior. As to feature engineering, features can be generated using reconstruction errors to build another ML model. For example, consider use of a random survival forest model that can provide predictions as a survival curve for each timestamp. Given a survival curve, remaining useful life (RUL) of a pump can be evaluated.

A random survival forest (RSF) is an ensemble of tree-based learners. A RSF ensures that individual trees are de-correlated by 1) building each tree on a different bootstrap sample of the original training data, and 2) at each node, evaluating the split criterion for a randomly selected subset of features and thresholds. Predictions can be formed by aggregating predictions of individual trees in the ensemble. The RSF can be constructed with numerous independent decision trees where each can receive a random subset of samples and randomly select a subset of variables at each split in a tree for prediction and where a final prediction can be an average of the prediction of each individual tree.

A RSF can be used, for example, to provide predictions for disease such as, for example, breast cancer. Consider a dataset for 686 women and 8 prognostic factors: 1. age, 2. estrogen receptor (estrec), 3. whether or not a hormonal therapy was administered (horTh), 4. menopausal status (menostat), 5. number of positive lymph nodes (pnodes), 6. progesterone receptor (progrec), 7. tumor size (tsize), 8. tumor grade (tgrade). In such an example, a goal can be to predict recurrence-free survival time. A method can include load the data and transform it into numeric values followed by splitting the data 75/25 for training and testing. As to training, one or more of several split criteria can be utilized (e.g., log-rank test, etc.). Once trained, the RSF can be tested using the testing data.

As to making predictions, a sample can be dropped down each tree in the forest until it reaches a terminal node. Data in each terminal node may be used to non-parametrically estimate the survival and cumulative hazard function, for example, using the Kaplan-Meier and Nelson-Aalen estimator, respectively. As an example, a risk score can be computed that represents the expected number of events for one particular terminal node. An ensemble prediction can be generated, for example, by averaging across the trees in the forest. As an example, a method can include generation of a predicted survival function, which may show differences within certain periods of time.

Referring again to FIG. 7, the method 750 includes an input channels block 751, an anomaly detector block 752 for health indicator (HI) modeling, an output channels block 753, a reconstruction error block 754, a feature generation block 755, a survival model block 756 for RUL modeling, and a survival probability curve block 757.

In the example of FIG. 7, the method 750 can include iterative modeling that may be performed by hyperparameter optimization for models utilized where an inference pipeline can be built. As an example, models can be packaged as a standalone container (e.g., DOCKER container, etc.) that can reside on a physical gateway (e.g., an edge device). As explained with respect to the example of FIG. 6, a containerized set of models can provide for interactions with one or more applications on the edge to provide a survival probability curve for signals, which may be at each timestamp per well, which may be visualized on one or more devices.

Figure 8:
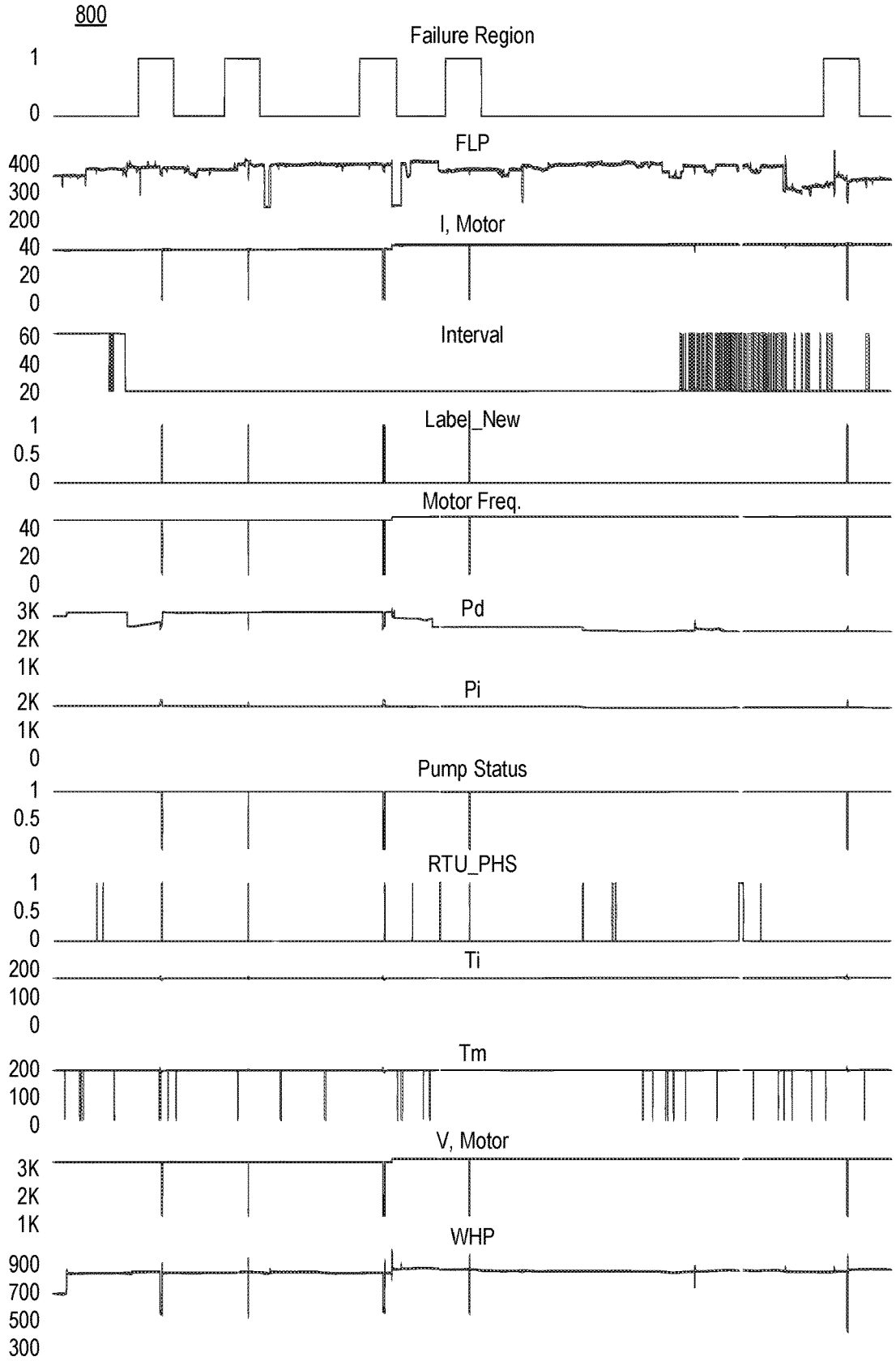
FIG. 8 illustrates an example of a graphical user interface of plots of time series data.

FIG. 8 shows an example of a graphical user interface (GUI) 800 that includes plots with respect to time for a period of one year where the plots can include a failure region plot, a flowing bottom hole pressure (FLP) plot, a motor current plot, an interval plot, a label plot, a motor frequency plot, a pressure plot, another pressure plot, a pump status plot, a remote terminal unit phase (RTU_PHS) plot, a temperature plot, another temperature plot, a motor voltage plot and a work horsepower plot. In the GUI 800, instances of motor current and motor frequency dropping to zero are indicated, each of which has a corresponding failure regions. Further, plots for pump status and RTU_PHS indicate such instances. Various data channels can provide signatures, for example, within the failure regions prior to zero current and/or zero voltage.

Figure 9:
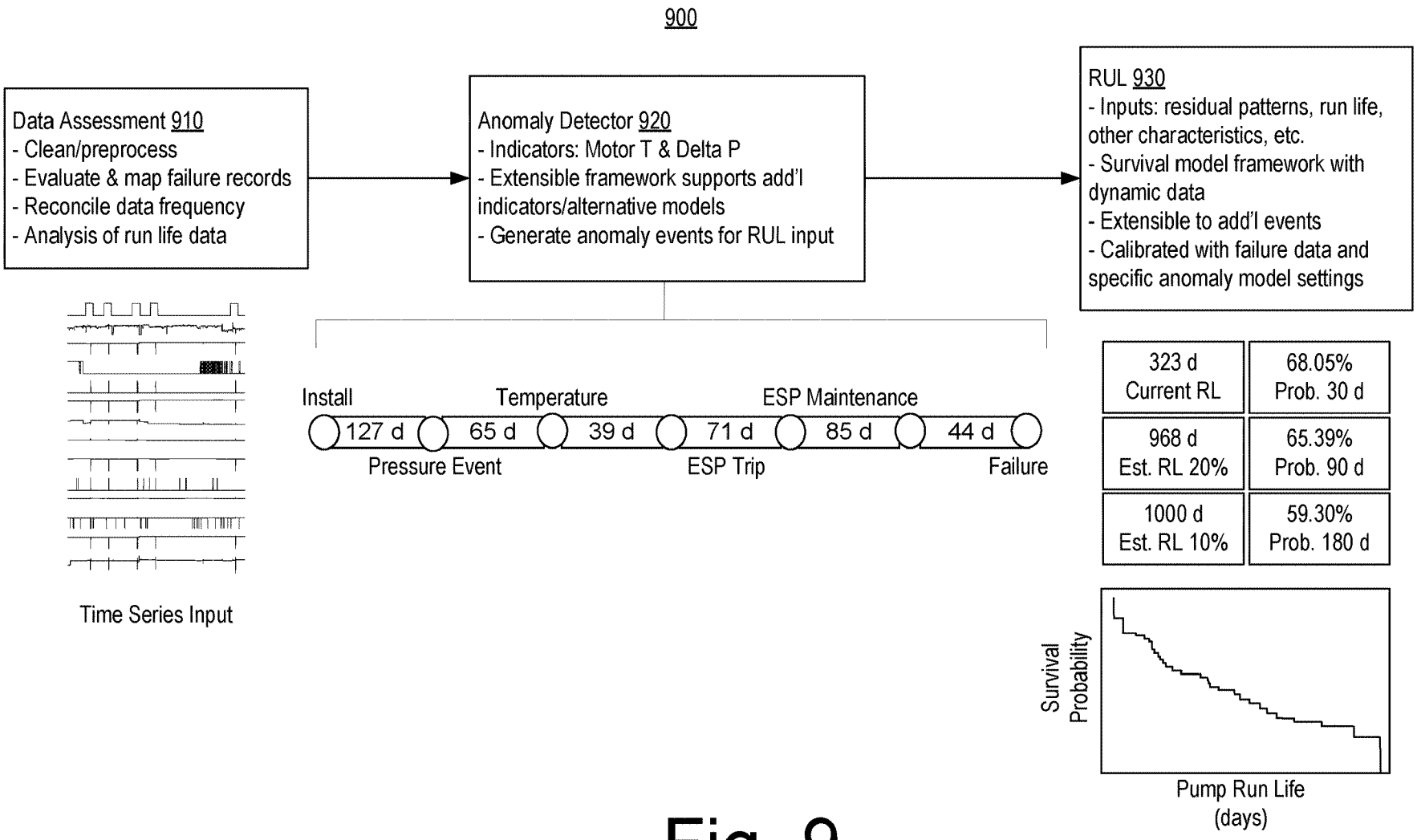
FIG. 9 illustrates an example of a system.

FIG. 9 shows an example of a system 900 for performing a workflow using various components. As shown, the workflow group of components can include a data assessment component 910 can provide for cleansing and preprocessing data, evaluating and mapping failure records, reconciling data frequency, performing analyses of run life data (e.g., statistical analyses, etc.), etc.; an anomaly detector component 920 can provide for pump indicators (e.g., motor temperature, delta pressure, etc.), modeling framework support for one or more additional indicators and/or one or more alternative models, and generation of pump anomaly events for one or more types of pumps that can be utilized as input to one or more remaining useful life (RUL) models, etc.; and a remaining useful life (RUL) component 930 can provide for receipt of inputs (e.g., residual patterns, run life, and/or one or more other characteristics), a survival model framework for use with dynamic data for one or more types of pumps, extensibility for one or more types of pump events for one or more types of pumps, calibration with failure data and specific anomaly model settings, etc.

As an example, the component 910 can provide for evaluation of pump high-frequency data, evaluation of part-level failure records and reconciliation of data frequency; the component 920 can provide for building normal behavior models (e.g., autoencoder, clustering, isolation forest, etc.) and for using normal behavior models to compute deviations as input features; and the component 930 can provide for computing input features using both normal model deviations and input features from one or more pumps and metadata and for building one or more RUL models (e.g., time-dependent Cox mode, random survival forest as survival curve, etc.).

In the system 900, examples of input, a history of a pump or pumps for modeling, and examples of outputs are illustrated. As to the input, consider one or more of the plots of data of FIG. 8; as to the history, consider a pump history from installation to failure where various types of data, actions, etc., occur over time; and as to the output, consider run life (RL) with respect to current, estimated, etc., which can be accompanied by probabilities with respect to a number of days (e.g., 30, 90, 180, etc.), along with one or more plots such as a plot of survival probability versus run life in days.

As an example, the system 900 may be utilized to access historical data for one or more pumps (e.g., pump systems, etc.) such that a complete or more complete history can be established. As indicated in FIG. 9, a history of a pump may extend from an installation date to a failure or end of life date. As an example, one or more ML models may be trained using a full or more full set of data as to a pump, which may be accessed from one or more databases, local memory of a pump or pump system, etc. For example, consider a ML model trained using historical data to be a digital twin of a pump or pump system such that the trained ML model can be utilized to test or predict behavior of the pump or pump system given particular input (e.g., operational parameters, environmental conditions, etc.). As an example, a digital twin may be a predictive model for prediction of normal expected behavior, which may be utilized, for example, in combination with an anomaly detection model and/or a survival model, for example, to facilitate field operations, which can include control of one or more pumps in the field. As an example, a digital twin may be utilized for generation of scenarios that may aim to improve RUL and/or one or more performance goals where, for example, responsive to an undesirable predicted RUL, one of the scenarios may be selected for implementation in an effort to improve RUL and/or performance. As an example, a digital twin model may be an autoencoder model or another type of model. As an example, a digital twin model may be part of an anomaly detection model where, for example, a deviation between actual behavior and predicted behavior, by the digital twin model, may be a basis for anomaly detection. As an example, an anomaly detection model may have one or more uses in a system (e.g., a framework, etc.) for purposes of managing, monitoring, controlling, etc., one or more pumps.

As explained with respect to FIG. 6, a system can be implemented on an edge device, which can include containerized components accessible via one or more APIs, for example, to receive calls from one or more applications (see, e.g., the system 600). As an example, an edge device can be a controller that can issue one or more control signals to control operation of a pump, for example, responsive to failure prediction, a survival issue, etc.

Figure 10:
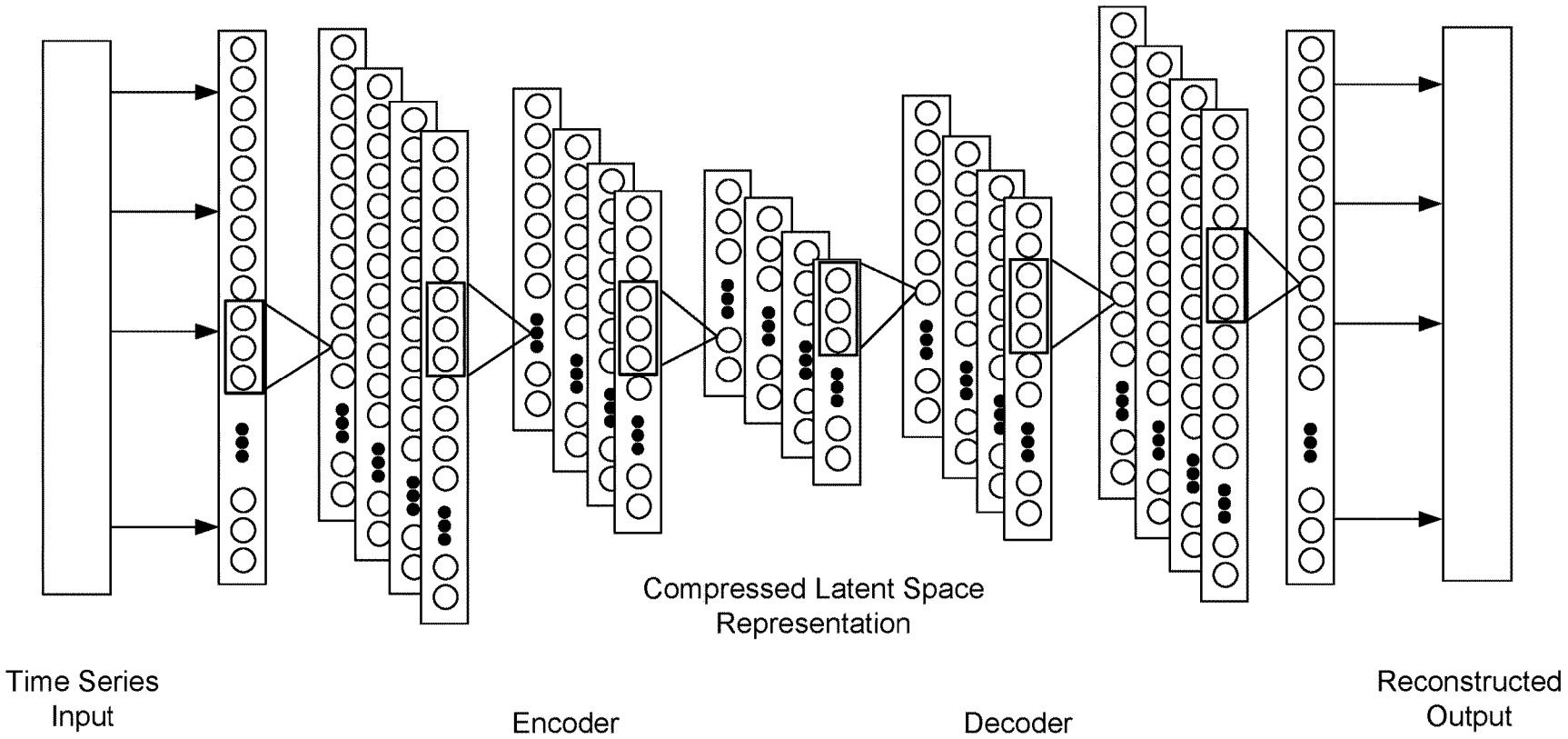
FIG. 10 illustrates an example of a machine learning model architecture.

FIG. 10 shows an example of a ML model architecture 1000 that includes an encoder or compressor and a decoder or decompressor. As shown, the ML model architecture 1000 can reduce dimensionality of time series input to a compressed latent space representation (e.g., a feature space) that may be utilized for one or more purposes. However, as mentioned, upon decoding or decompressing, the compressed latent space representation can be processed to generate time series output that can be compared to the time series input. The ML model architecture 1000 can be an input reconstructor where input and machine reconstruction thereof, referred to as output, can be compared. In general, a ML model is accurate when the input and output compare favorably, however, as explained, where they do not, that can be an indication that the ML model is not properly trained or not trained as to particular input. As explained, by training a ML model using normal behavior data, it may not suitably reconstruct abnormal behavior data (e.g., anomalous behavior data), which can thereby be an indication that abnormal (e.g., anomalous) behavior exists. As explained, reconstruction error can be utilized as a metric to quantitatively and/or qualitatively assess a trained ML models ability and inability to reconstruct input, which can be utilized as a proxy for the existence of abnormal (e.g., anomalous) behavior.

As an example, one or more other types of models may be utilized, additionally or alternatively for purposes of anomaly detection. For example, consider an unsupervised clustering model, an unsupervised isolation forest model, etc. As an example, a type of model may be selected on a basis of available data. For example, where an amount of data is sufficient to train an autoencoder, an autoencoder may be utilized; whereas, where data are not sufficient to adequately train an autoencoder, another type of model may be selected that demands less data. As an example, a system such as, for example, the system 900 of FIG. 9 may automatically select a model for anomaly detection based at least in part on an amount of available data and/or quality of available data. As an example, a system may include one or more components for data augmentation and/or supplementation to increase an effective amount of data. As an example, a system may switch model types, optionally using multiple model types, as more data become available. For example, consider running a lightweight model for anomaly prediction while awaiting additional data and then commencing training of a heavier weight model for anomaly prediction. In such an example, multiple models (e.g., an ensemble) may execute at least in part simultaneously to provide for anomaly detection where output of the models may be assessed. In such an example, one model may be better at detecting one type of anomaly while another model may be better at detecting another type of anomaly or, for example, one model may excel at detecting anomalies such that that model is selected for use while one or more other models are shut down. As an example, a framework may be dynamic as to model selection, model switching, etc., for example, in a data dependent manner that aims to improve anomaly detection.

As an example, an unsupervised clustering model may implement a k-means approach where the number of clusters, k, may be optimized as a hyperparameter, for example, using an elbow technique or other suitable technique. The elbow technique can utilize a heuristic to determine the number of clusters in a data set, for example, by plotting explained variation as a function of the number of clusters and picking the elbow in a plotted curve as the number of clusters to use. Such an approach may also be utilized to choose the number of parameters in one or more other types of data-driven models (e.g., number of principal components to describe a data set). As to anomaly detection, clustering can highlight (e.g., identify) anomalies in data. For example, consider outliers that do not fit into one or more clusters and/or one or more clusters that may be associated with anomalies can include, for example, relatively few members.

As an example, an unsupervised isolation forest model can be utilized to directly detect anomalies using isolation (e.g., how far a data point is to the rest of the data). Such an approach may run in a linear time complexity akin to distance-related models such as k-nearest neighbors (KNN), which may also be utilized for anomaly detection. An isolation forest can provide for pivoting on attributes of an outlier such as there will be few outliers and that outliers will be different characteristically than non-outliers. An isolation forest can introduce an ensemble of binary trees that recursively generate partitions by randomly selecting a feature and then randomly selecting a split value for the feature. The partitioning process can continue until it separates data points from the rest of the samples. In an isolation forest, an outlier can be expected to demand fewer partitions on average to get isolated compared to normal samples. Each data point can then receive a score based on how easily they are isolated after a number of rounds such that data points that have abnormal scores can be detected as anomalies.

As explained, a RSF can be utilized in a system where a workflow can include computing input features using both normal model deviations and input features from pump data and metadata and building RUL model(s) using a RSF for survival curve generation.

As an example, a time-dependent Cox model may be utilized for purposes of survival (e.g., RUL). A time-dependent Cox model can be a time-dependent Cox regression model (TDCM), which quantifies the effect of repeated measures of covariates in an analysis of time to event data. As an example, one or more of a pooled logistic regression model (PLRM), a cross sectional pooling model (CSPM), a Kaplan-Meier survival model and a log-rank test model may be implemented (e.g., for output, for comparisons, for additional output, etc.). As an example, a survival model that accounts (e.g., statistically) for times at which time dependent covariates are measured may provide more reliable estimates compared to an unadjusted approach.

Figure 11:
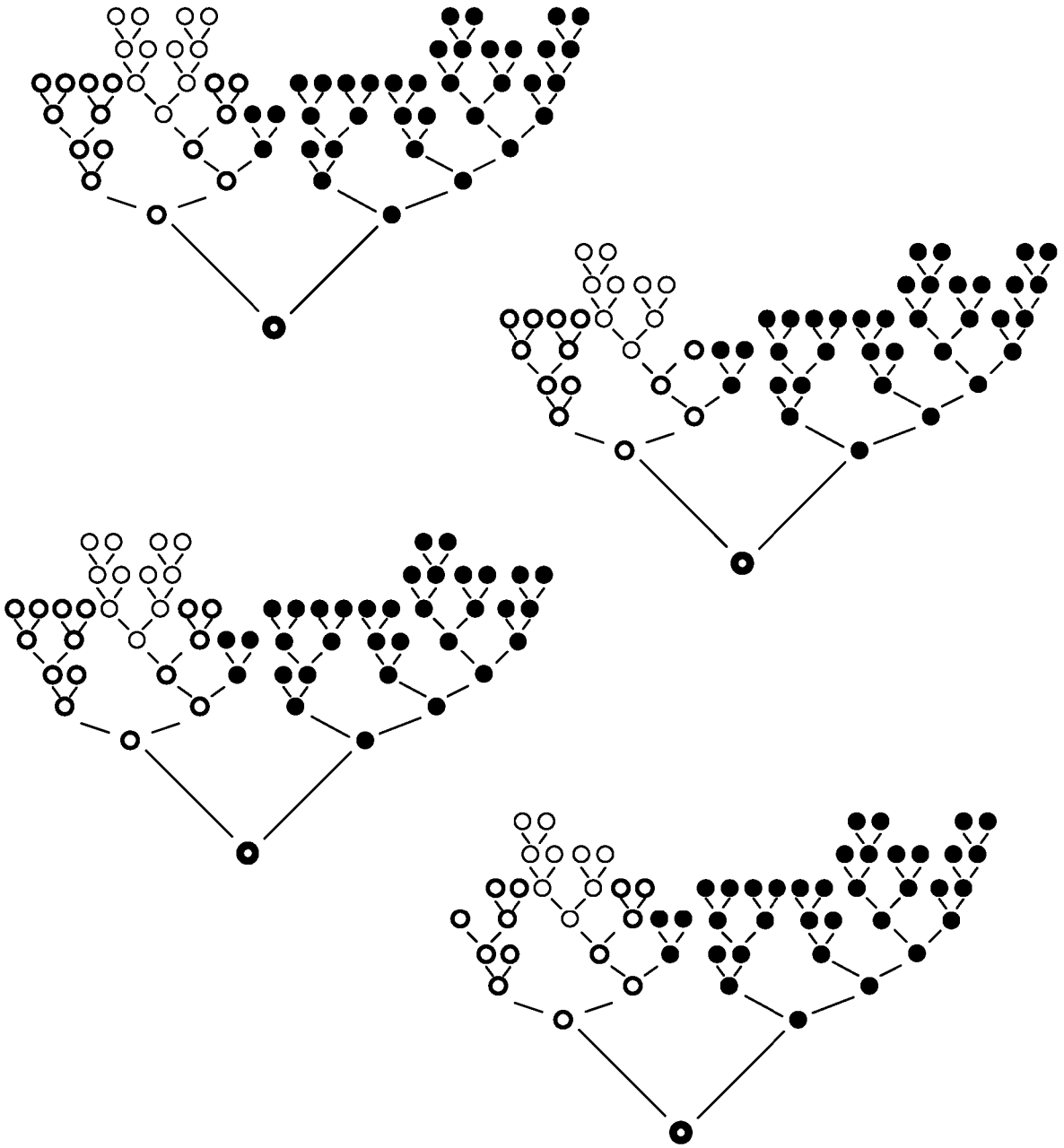
FIG. 11 illustrates examples of machine learning tree models.

FIG. 11 shows some examples of trees 1100 in an RSF, which can differ as to one or more aspects. As explained, outputs from a number of trees may be utilized for generation of RUL output; noting that one or more other techniques may be utilized (e.g., time-dependent Cox model, etc.).

Figure 12:
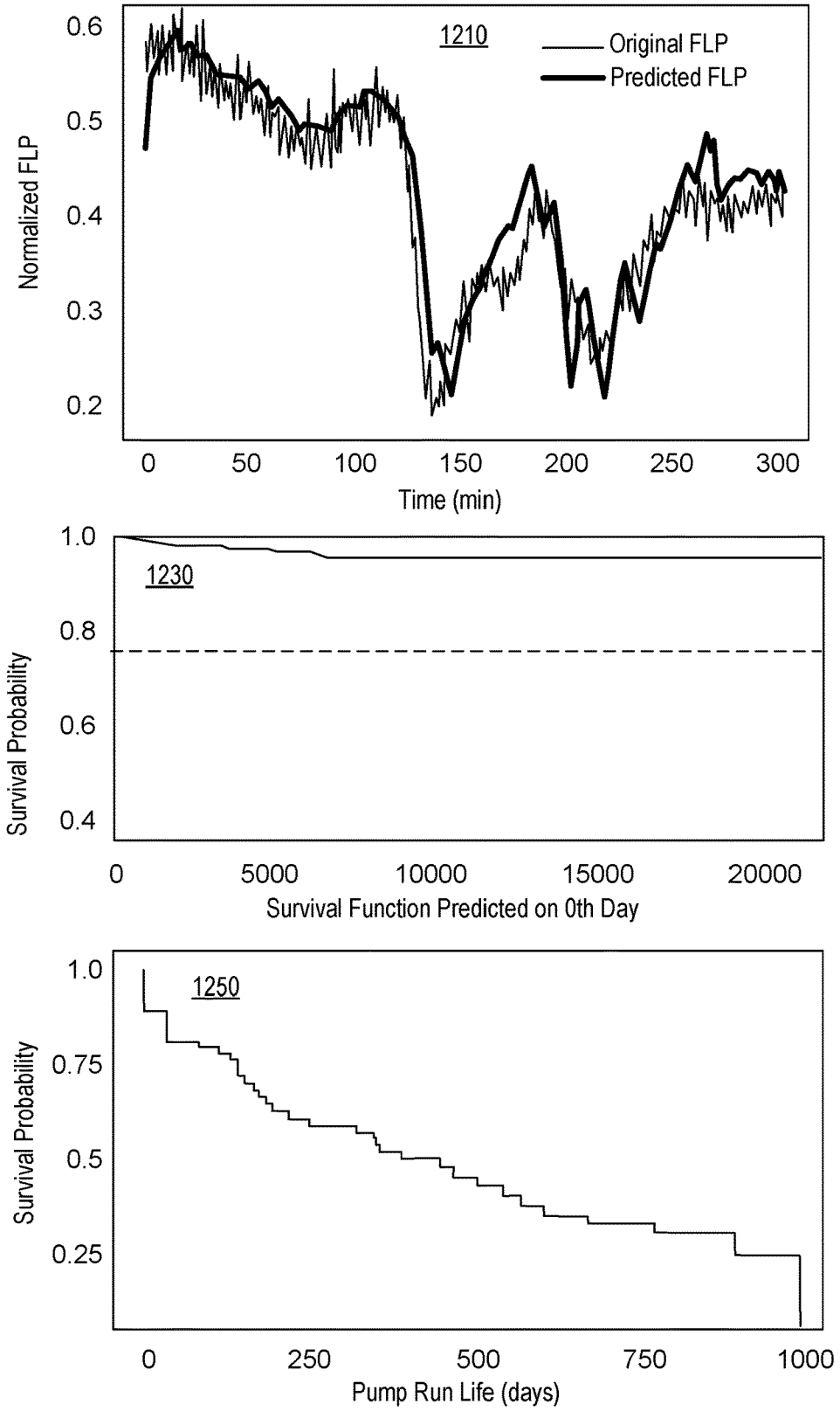
FIG. 12 illustrates examples of plots.

FIG. 12 shows examples of plots 1210, 1230 and 1250. Specifically, the plot 1210 shows actual values versus predicted values over a period of time of approximately 300 minutes. In the plot 1230, a threshold is indicated by a dashed line while a predicted survival function with respect to time is indicated by a solid line. As time progresses, additional data can be received and the plots 1210 and 1230 updated. For example, multichannel data can be received as input to a first trained ML model to generate output where the output can be compared to the input to generate reconstruction errors where such reconstruction errors can be utilized by a second trained ML model to generate a survival function. In the example of FIG. 12, the input may be windowed as appropriate and updated according to a time interval, an event, etc. For example, consider a window of 300 minutes with a time interval of approximately 5 minutes. In such an approach, a threshold or thresholds may be utilized with respect to probability of survival with respect to time to determine a future time where a decreased probability of survival exists where one or more actions may be called for between the present time and the future time, for example, in an effort to increase probability of survival, mitigate impact of failure, prepare for service, etc. As to the plot 1250, it shows survival probability versus pump run life in days. As shown, as days progress, the survival probability decreases. As explained, such a plot can be generated by a workflow using, for example, components such as the components 910, 920 and 930 of the system 900 of FIG. 9.

As an example, a method can include predicting how long will a pump system will survive through use of a model that is trained using normal behavior data where error in reconstructing normal behavior data by the trained model can be indicative of abnormal (e.g., anomalous) behavior and where metrics related to reconstruction error can be utilized by another model that can generate a survival function with respect to time.

As to input, it can include multichannel input, for example, consider one or more of the following channels: current, voltage, intake pressure, discharge pressure, wellhead pressure, flow rate, temperature, etc.

As explained, an autoencoder is an example of a type of ML model that can be trained to imitate input where, for purposes of training, the input can be normal behavior data, which may be sorted from abnormal behavior data in one or more datasets. As an example, regions that are a number of days prior to a failure and a number of days after a failure can be deemed regions that include abnormal or anomalous behavior. For example, for an ESP, consider 15 days before and 5 days after a failure as being a failure region that can include one or more signatures of failure (e.g., future, present and past). Such one or more signatures may be identified in reconstruction errors for an autoencoder where labeling can be utilized to provide time between a signature and a failure. Such labeled data can be utilized to train another type of ML model such as a RSF model. As explained, reconstruction error can be relatively high in regions when a problem is developing where reconstruction error may be generated on a channel-by-channel basis and/or one or more other bases (e.g., overall error as a sum, an average, etc.). A RSF model may be utilized to predict a remaining useful life (RUL) of pump equipment, for example, via a survival function with respect to time. As explained, while an autoencoder and RSF are mentioned, one or more other types of models may be utilized for anomaly detection and/or RUL prediction.

As mentioned, supervised training can involve labeling such that training occurs through use of labeled data. As explained, labels can pertain to time between a signature and a failure (see, e.g., the time series data of FIG. 8). Given labeled data, a RSF can be trained to predict time of failure for one or more signatures, which may be signatures of one or more features (e.g., model features, etc.). As explained, a survival function can be scaled for probabilities from zero to unity with respect to time such that the output of a trained RSF can be a curve. Through use of a threshold (e.g., a probability value less than one), a future time can be identified where a curve crosses the threshold. For example, a model can predict that in four days, there will be a substantially lower probability of pump equipment surviving.

Referring to the plot 1230, the survival function spans a period of time of 15 days (e.g., over 20,000 minutes) where the plot 1210 spans a period of time of 300 minutes (e.g., 5 hours), which may be updated every 5 minutes. In the plot 1230 a threshold of 0.75 is utilized and the survival function indicates that over the next 15 days, the probability of survival is greater than 0.75. However, if a deviation occurs in the plot 1210 between the input and reconstructed input (e.g., the output), then the survival function can be generated to include probabilities over the next 15 days that are less than or equal to 0.75. In such an example, the future time at which the curve crosses the threshold may be utilized to trigger an alarm, a control action, etc., such that one or more actions can be taken to address the decreased probability of survival prior to the future time. As explained, a survival function can evolve over time such that an operator and/or a controller can determine whether the risk still exists and/or whether one or more actions taken may have mitigated the risk.

The multi-model approach to prediction of survival (e.g., remaining useful life, etc.) operates beyond mere real-time failure detection and improves the ability to address one or more issues. As explained, a system can provide for prediction of pump equipment behavior in advance by estimating the run life over time. Such a system can provide for prognostic health management for one or more sets of pump equipment and allow for swift maintenance to improve production, reduce overhead costs of equipment replacement and save SME review time. In various instances, non-productive time (NPT) may be scheduled and/or reduced. For example, consider the amount of time it may take to run in and/or run out an ESP from a wellbore. In such an example, if a run in (e.g., trip in) and/or a run out (e.g., trip out) can be planned to coincide, at least in part, with one or more other types of operations (e.g., NPT or non-NPT), then NPT and/or resource production and/or resource utilization may be reduced. In contrast, an unexpected, unpredicted event that demands tripping out an ESP at a site can introduce substantial NPT as equipment may not be available at the site and that resource production can be reduced for an extended period of time (e.g., time to get equipment to site, trip out the failed ESP and trip in an operable ESP).

As explained, a system can be local such as an edge device system that can run in real-time with one or more edge application calculations to make predictions multiple days in the future. Such a system can provide accurate assessments of expectation of failures in pump systems. As an example, a system may be deployed on-premises and/or on the cloud (e.g., as a SaaS product, etc.).

As an example, a system can utilize complex ML techniques that do not necessarily demand the presence of an identifiable, consistent failure precursor. As an example, a system can be lightweight (e.g., an IoT or edge device) with a quick response time.

Figure 13:
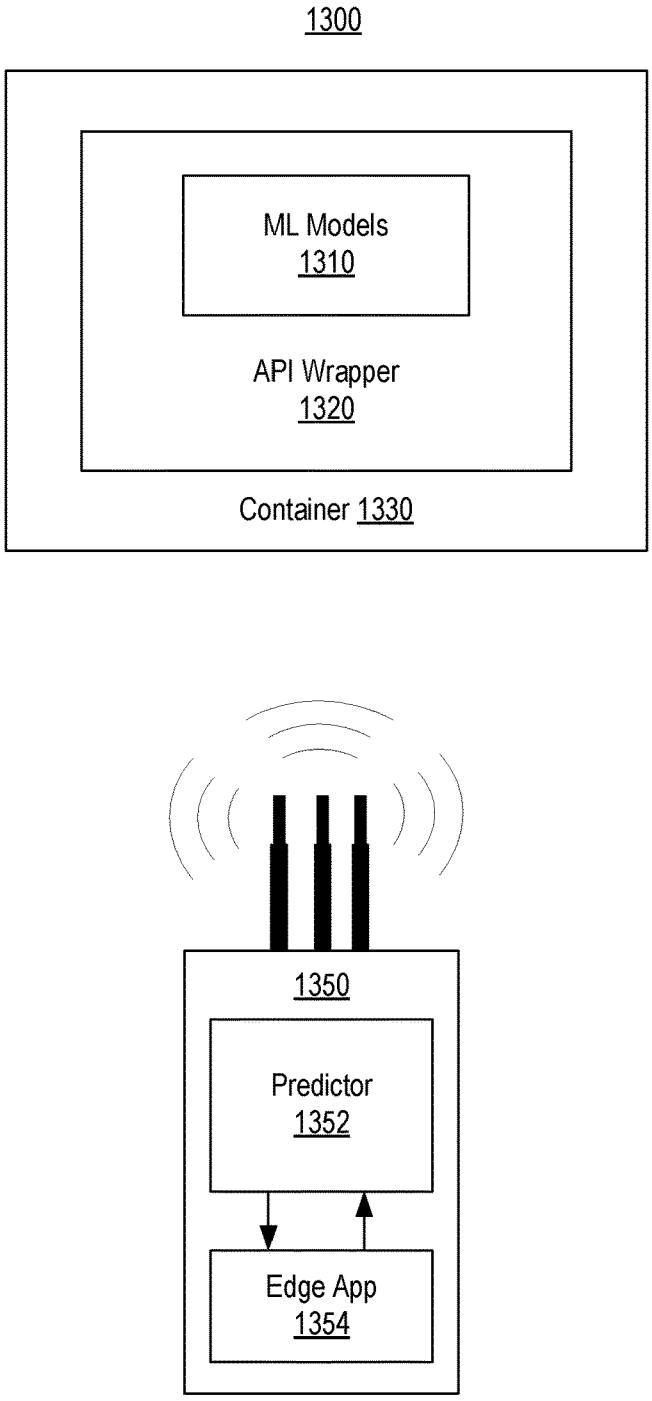
FIG. 13 illustrates an example of a system.

FIG. 13 shows an example of a system 1300 that can include one or more containerized ML models 1310 hosted within an application programming interface (API) wrapper 1320 within a container 1330. In such an example, the containerized ML models 1310 can be deployed in the field, for example, using an edge computing device 1350 with predictor 1352 and edge application 1354 components. In such an example, the edge application component 1354 can provide for processing of data such that the data or data derived therefrom are in a form suitable for ingestion by the predictor 1352 (e.g., appropriate ML model inputs, etc.).

In the example trials, a data science framework was implemented (DATAIKU) along with a container framework (DOCKER). The container framework provides for construction of a unit of software that packages up executable code and its dependencies such that an application can execute quickly and reliably from one computing environment to another. As an example, a container can be an image that is a lightweight, standalone, executable package of software that includes code, runtime, system tools, system libraries and settings. A container image becomes a "container" at runtime, for example, when run on a suitable engine (e.g., DOCKER engine for a DOCKER container image). As an example, an edge implementation may utilize a framework such as, for example, a lightweight machine learning framework such as the TENSORFLOW LITE (TFL) framework (GOOGLE LLC, Mountain View, California).

As an example, a model inference pipeline can be set up inside a container, wrapped around an asynchronous server gateway interface (ASGI) based API technology to allow for real-time requests and responses (see, e.g., arrows in the edge computing device 1350 of FIG. 13). As an example, pump signals can be received as expected by a ML model in real-time to produce as output, which may be utilized by another ML model to generate a survival function. Such an approach allows for continuous monitoring and/or control and parallel computation on multiple gateways.

Figure 14:
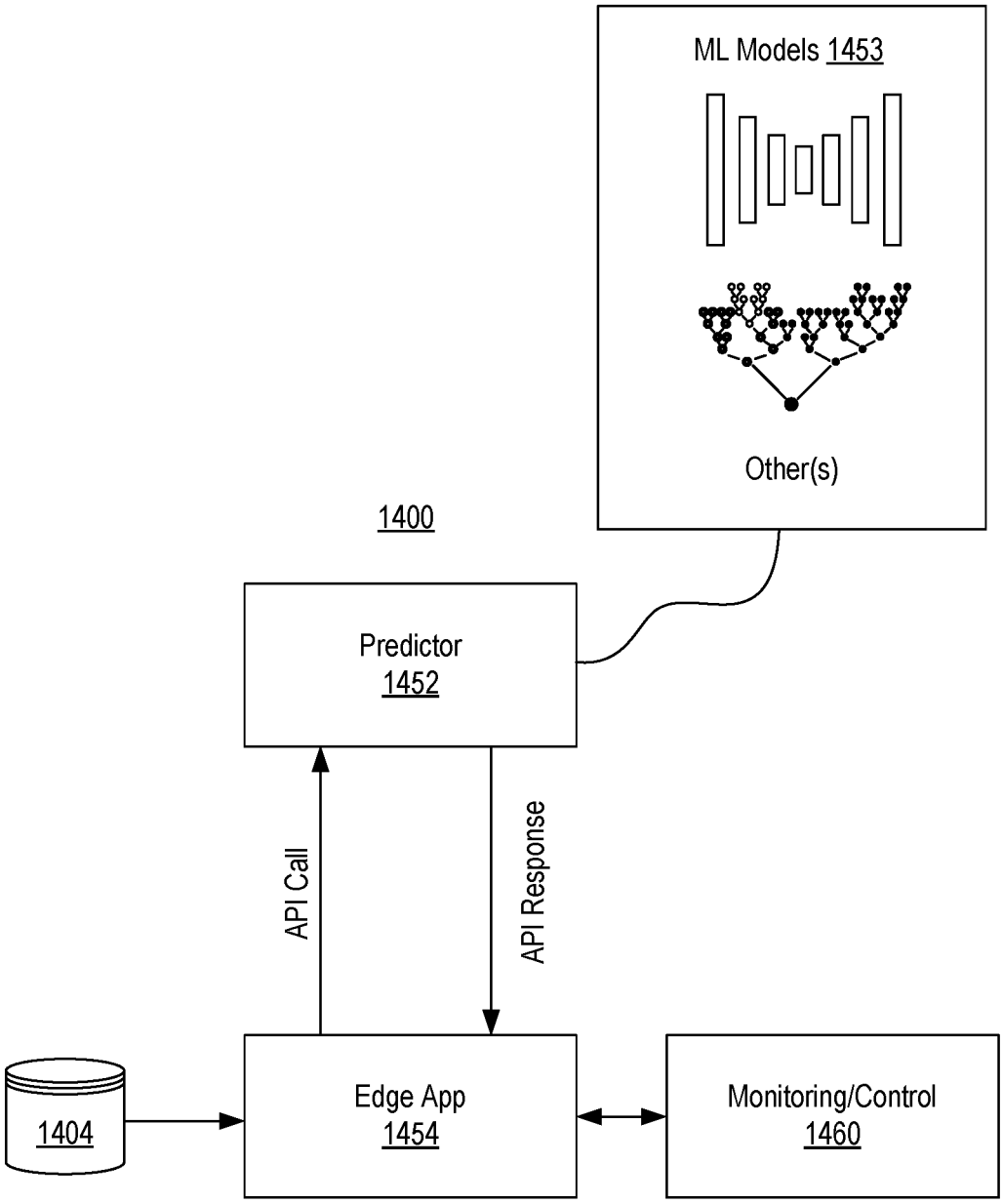
FIG. 14 illustrates an example of a system.

FIG. 14 shows an example of a system 1400 that includes a data source 1404 that can provide, for example, real-time data from one or more sensors deployed in the field as part of or otherwise associated with a pump, an instance of a predictor 1452, an instance of an edge application 1454 and a monitoring and/or control component 1460. As shown, the predictor 1452 may receive an API call (e.g., an API request) issued by the edge application 1454 and where the predictor 1452 acts responsive to the API call to generate an API response directed to the edge application 1454. As shown, the monitoring and/or control component 1460 can be operatively coupled to the edge application 1454 for transmission of data, issuance of an alarm or alarms, issuance of a control command, etc. As explained, the edge application 1454 can provide for data processing, data derivations, etc., which may be suitable for generating appropriate input for the predictor 1452.

In the example of FIG. 14, examples of ML models 1453 are shown, which may include an anomaly detector ML model and a RUL ML model. While an autoencoder and a tree are shown, as mentioned, one or more other types of models may be utilized additionally or alternatively. As explained, data can be utilized as input and/or can be processed to generate input for a ML model or ML models where the ML model or ML models can provide one or more outputs. As an example, a ML model or ML models may output probabilities as predictions, etc., which may be tracked for a period of time or over a number of calls, where if output is consistent over such a period of time of the number of calls, an ultimate determination may be made, which may then trigger issuance of an alarm and/or a control instruction.

The example system 1400 of FIG. 14 can be scalable, customizable and standalone and provide reliability and robustness upon initial deployment to an edge computing device or edge computing devices. Such a system may provide real-time results for multiple pumps for multiple wells, reducing downtime for various wells.

As explained, one or more features of a system may be associated with equipment that can be deployed downhole. For example, the circuitry 460 of FIG. 4 can include one or more features of the edge device 510 of FIG. 5, which can, for example, provide for hosting the predictor 1452 and the edge application 1454 of FIG. 14; noting that multiple predictors and/or applications may be hosted (e.g., wholly and/or in part). As an example, an ESP may itself be a "smart" ESP that includes one or more executable models (e.g., ML models, etc.) that can provide for monitoring and/or control of the ESP. As explained, circuitry may be carried by a gauge that can be mounted to an assembly that includes a pump and a motor where one or more sensors of the gauge can provide inputs to monitoring and/or control circuitry.

As an example, a system, a method, etc., may utilize one or more machine learning features, which can be implemented using one or more machine learning models. As to types of machine learning models, consider one or more of a support vector machine (SVM) model, a k-nearest neighbors (KNN) model, an ensemble classifier model, a neural network (NN) model, etc. As an example, a machine learning model can be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a machine model may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange and various other frameworks.

As an example, a system may utilize one or more recurrent neural networks (RNNs). One type of RNN is referred to as long short-term memory (LSTM), which can be a unit or component (e.g., of one or more units) that can be in a layer or layers. A LSTM component can be a type of artificial neural network (ANN) designed to recognize patterns in sequences of data, such as time series data. When provided with time series data, LSTMs take time and sequence into account such that an LSTM can include a temporal dimension. For example, consider utilization of one or more RNNs for processing temporal data from one or more sources, optionally in combination with spatial data. Such an approach may recognize temporal patterns, which may be utilized for making predictions (e.g., as to a pattern or patterns for future times, etc.).

As an example, the TENSORFLOW framework (Google LLC, Mountain View, CA) may be implemented, which is an open source software library for dataflow programming that includes a symbolic math library, which can be implemented for machine learning applications that can include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California).

As an example, a training method can include various actions that can operate on a dataset to train a ML model. As an example, a dataset can be split into training data and test data where test data can provide for evaluation. A method can include cross-validation of parameters and best parameters, which can be provided for model training.

The TENSORFLOW framework can run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system based platforms.

TENSORFLOW computations can be expressed as stateful dataflow graphs; noting that the name TENSORFLOW derives from the operations that such neural networks perform on multidimensional data arrays. Such arrays can be referred to as "tensors".

As an example, a device and/or distributed devices may utilize TENSORFLOW LITE (TFL) or another type of lightweight framework. TFL is a set of tools that enables on-device machine learning where models may run on mobile, embedded, and IoT devices. TFL is optimized for on-device machine learning, by addressing latency (no round-trip to a server), privacy (no personal data leaves the device), connectivity (Internet connectivity is demanded), size (reduced model and binary size) and power consumption (e.g., efficient inference and a lack of network connections). TFL offers multiple platform support, covering ANDROID and iOS devices, embedded LINUX, and microcontrollers; diverse language support, which includes JAVA, SWIFT, Objective-C, C++, and PYTHON; and high performance, with hardware acceleration and model optimization. Machine learning tasks may include, for example, data processing, image classification, object detection, pose estimation, question answering, text classification, etc., on multiple platforms. As an example, the system 500 of FIG. 5 may utilize one or more features of the TFL framework.

Figure 15:
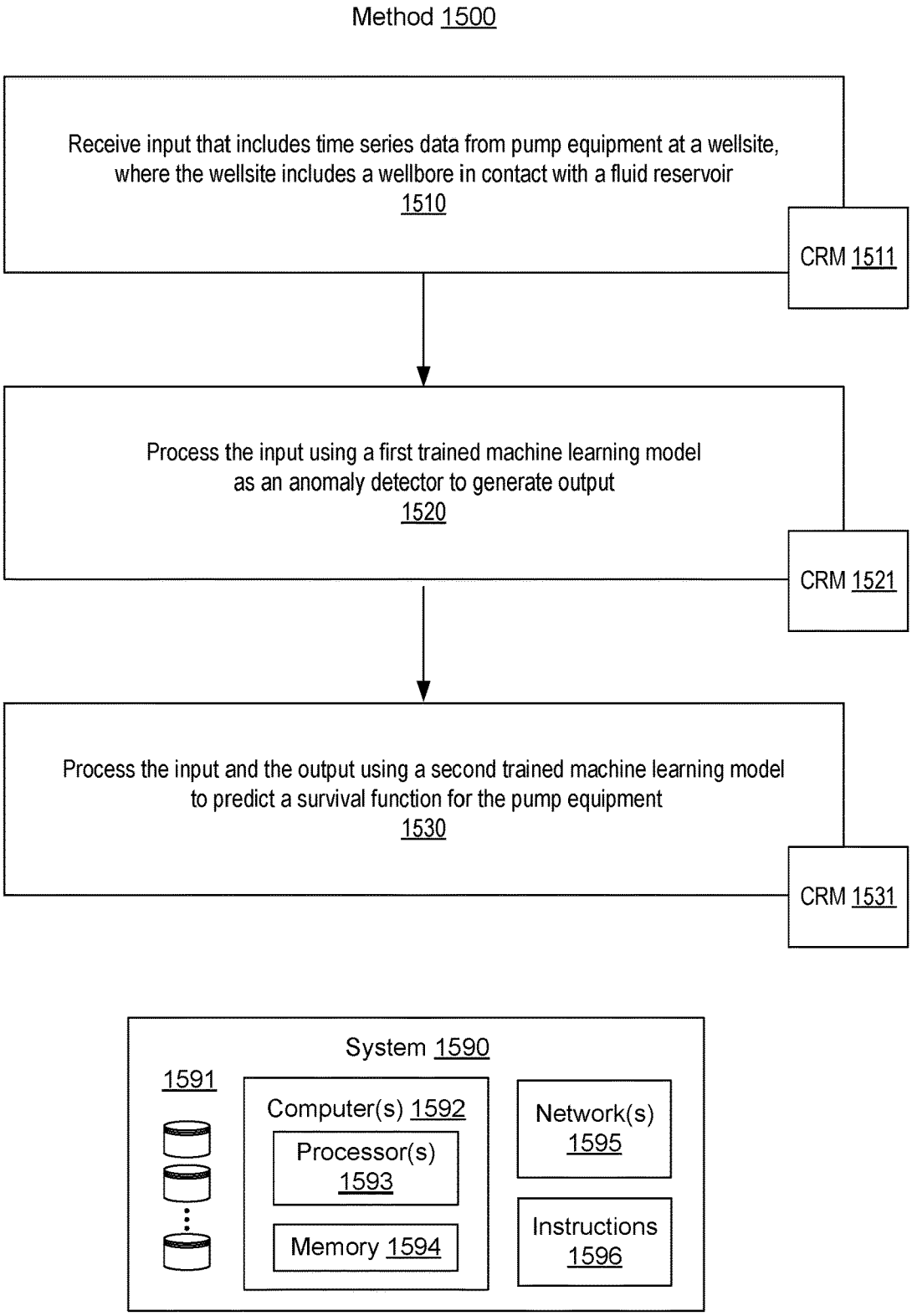
FIG. 15 illustrates an example of a method and an example of a system.

FIG. 15 shows an example of a method 1500 and an example of a system 1590. As shown, the method 1500 can include a reception block 1510 receiving input that includes time series data from pump equipment at a wellsite, where the wellsite includes a wellbore in contact with a fluid reservoir; a process block 1520 for processing the input using a first trained machine learning model as an anomaly detector to generate output; and a process block 1530 for processing the input and the output using a second trained machine learning model to predict a survival function for the pump equipment.

The method 1500 is shown in FIG. 15 in association with various computer-readable media (CRM) blocks 1511, 1521 and 1531. Such blocks generally include instructions suitable for execution by one or more processors (or processor cores) to instruct a computing device or system to perform one or more actions. While various blocks are shown, a single medium may be configured with instructions to allow for, at least in part, performance of various actions of the method 1500. As an example, a computer-readable medium (CRM) may be a computer-readable storage medium that is non-transitory and that is not a carrier wave. As an example, one or more of the blocks 1511, 1521 and 1531 may be in the form of processor-executable instructions.

In the example of FIG. 15, the system 1590, which may be a wellsite system, can include one or more information storage devices 1591, one or more computers 1592, one or more networks 1595 and instructions 1596. As to the one or more computers 1592, each computer may include one or more processors (e.g., or processing cores) 1593 and memory 1594 for storing the instructions 1596, for example, executable by at least one of the one or more processors 1593 (see, e.g., the blocks 1511, 1521 and 1531). As an example, a computer may include one or more network interfaces (e.g., wired or wireless), one or more graphics cards, a display interface (e.g., wired or wireless), etc.

As an example, the system 500, the system 900, the system 1400, etc., may include memory that can store instructions such as instructions of one or more of the CRM blocks 1511, 1521 and 1531. As explained, a system can be operatively coupled to pump equipment in the field where, for example, the system can receive data from the pump equipment (e.g., directly and/or indirectly) and, as appropriate, issue one or more commands (e.g., control signals, etc.) to the pump equipment to cause the pump equipment to take one or more actions. As explained, an action may aim to extend run life, avert an anomaly, respond to occurrence of an anomaly, etc. In the realm of ESPs, as explained, an anomaly may relate to equipment and/or environment where an action or actions can address equipment and/or environment (e.g., consider sanding, flow and temperature, etc.).

Figure 16:
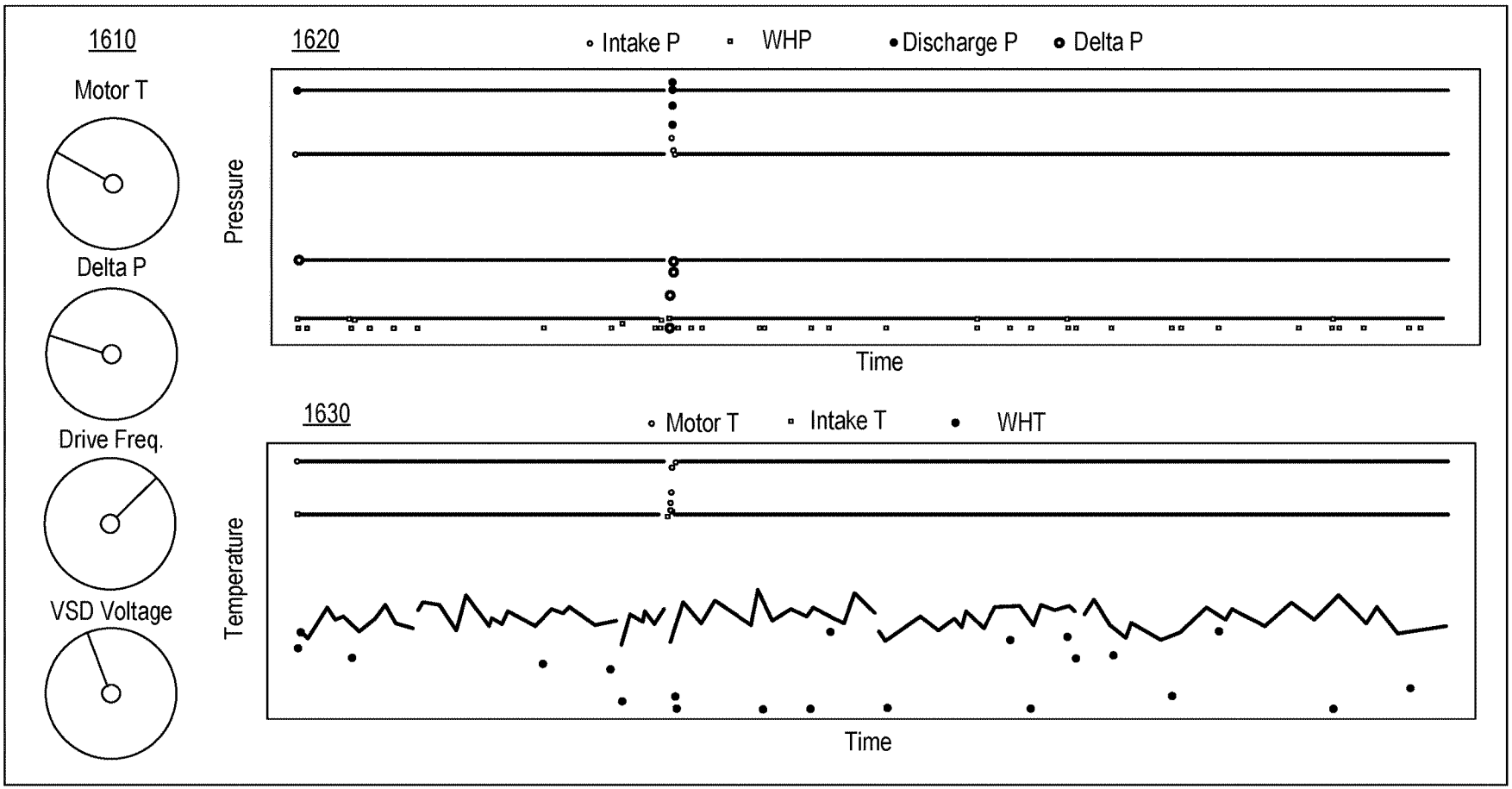
FIG. 16 illustrates an example of a graphical user interface.

FIG. 16 shows an example of a graphical user interface (GUI) 1600 that can include various graphical features such as, for example, a series of renderings of gauges 1610, a plot of pressure with respect to time 1620 and a plot of temperature with respect to time 1630. The GUI 1600 may be a data analytics GUI that can be selected from a number of different GUIs (e.g., overview, data analytics, alarms, RL analytics, settings, etc.). As shown, the gauges 1610 can include a motor temperature gauge, a delta pressure gauge, a drive frequency gauge and a VSD voltage gauge. In the example of FIG. 16, the GUI 1600 may be for a particular pump such as, for example, an ESP, installed at a site. As an example, the GUI 1600 can include a selector graphic for selection of a site, a pump, etc., where the GUI 1600 can be updated accordingly. As an example, the GUI 1600 may provide for renderings for more than one pump. For example, consider a fleet of pumps utilized at one or more sites. In such an approach, an individual can provide for oversight and making control decisions, which may be recommended. For example, consider a predicted event that may occur at a future time where a recommendation may be to reduce drive frequency to a specific value that may be indicated by a marker on the drive frequency gauge. In such an example, an individual may interact with the GUI 1600 to cause the VSD to reduce the drive frequency automatically to the recommended drive frequency (e.g., by clicking on the gauge, etc.). In such an approach, the graphics may be updated through operation of a framework to determine if the predicted event is avoided or extended to a suitable time (e.g., further out in time than the original prediction). In such an example, control of one or more pumps may be manual, automated, semi-automated, etc. For example, as to a semi-automated approach, consider an "accept" button of the GUI 1600 that can be actuated by an individual. As to an automated approach, consider one or more criteria that can be assessed for purposes of automatically adjusting one or more operational parameters of a pump in relationship to one or more predicted events, predicted decreases and/or increases in RUL, etc.

In the example of FIG. 16, the plot 1620 includes intake pressure, wellhead pressure (WHP), discharge pressure and delta pressure, while the plot 1630 includes motor temperature, intake temperature and wellhead temperature (WHT). As shown, variations can occur in pressure and in temperature. In particular, variations can occur in WHT which may include normal variations where such variations may be expected to exceed variations in motor temperature and intake temperature; noting that WHT may be expected to be lower than the motor and intake temperatures, with motor temperature being the highest.

Figure 17:
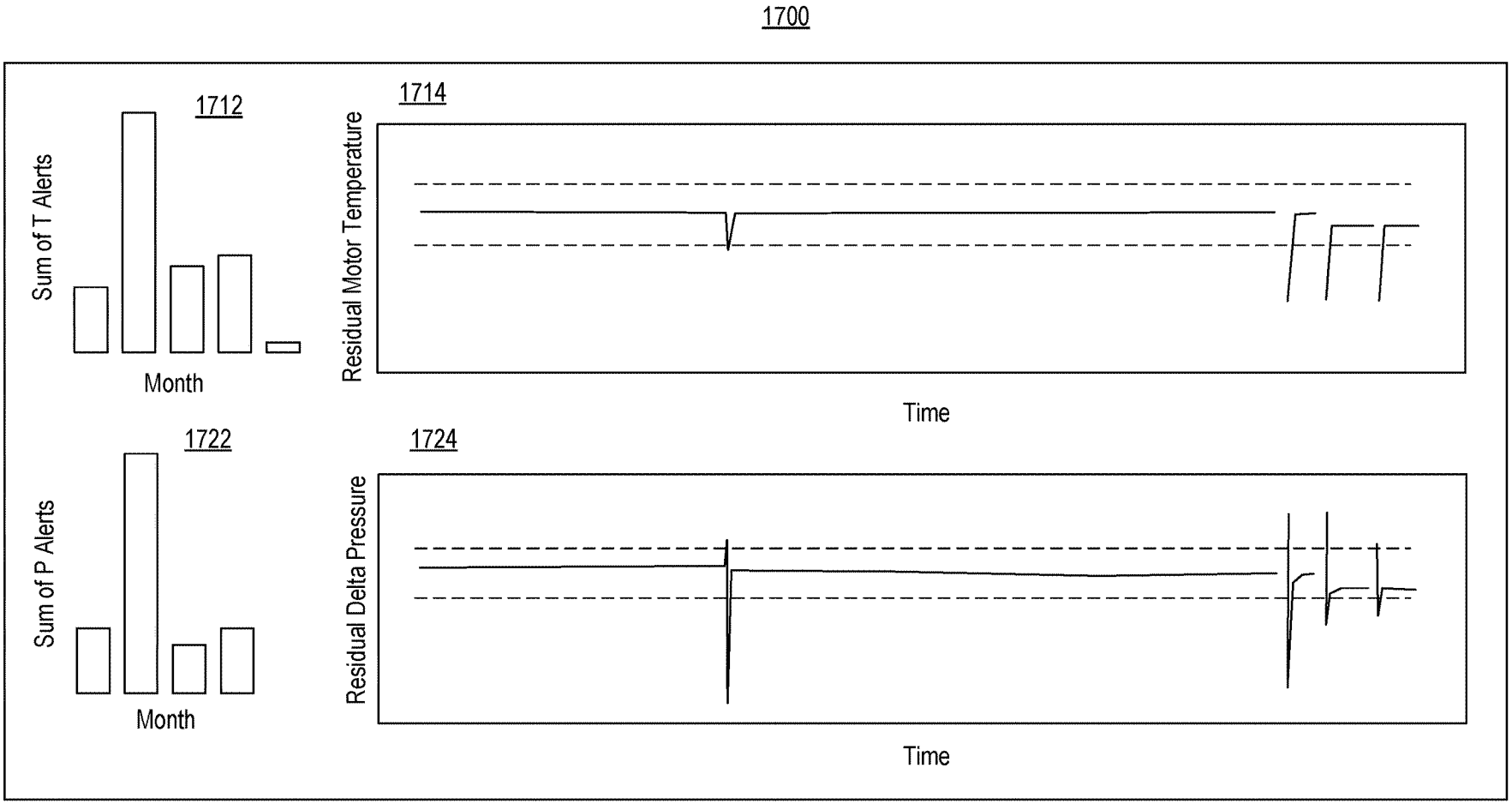
FIG. 17 illustrates an example of a graphical user interface.

FIG. 17 shows an example of a GUI 1700 that includes temperature information in plots 1712 and 1714 and pressure information in plots 1722 and 1724. In the example of FIG. 17, the GUI 1700 can be an anomaly detection GUI (e.g., an anomaly detection dashboard). For example, anomaly detection can be performed by an analysis of residuals, which can be based on a difference between actual measurements and model predictions. In such an example, anomalies can be identified when a residual exceeds a defined threshold (e.g., default, user defined, automatic, etc.). As an example, a threshold may be defined in terms of standard deviations from a rolling mean.

As shown in FIG. 17, the plots 1712 and 1722 show a sum or alerts for temperature and pressure respectively with respect to month of operation. In such plots, an individual can quickly assess monthly performance on the basis of two different measures. As to the plots 1714 and 1724, these plots show residual motor temperature and residual pressure with respect to time along with dashed lines that indicate upper and lower limits, which may be set using one or more statistical parameters (e.g., standard deviation, etc.). As with other GUIs, various features may be animated, color-coded, etc., where alerts may be issued as pop-outs, etc.

Figure 18:
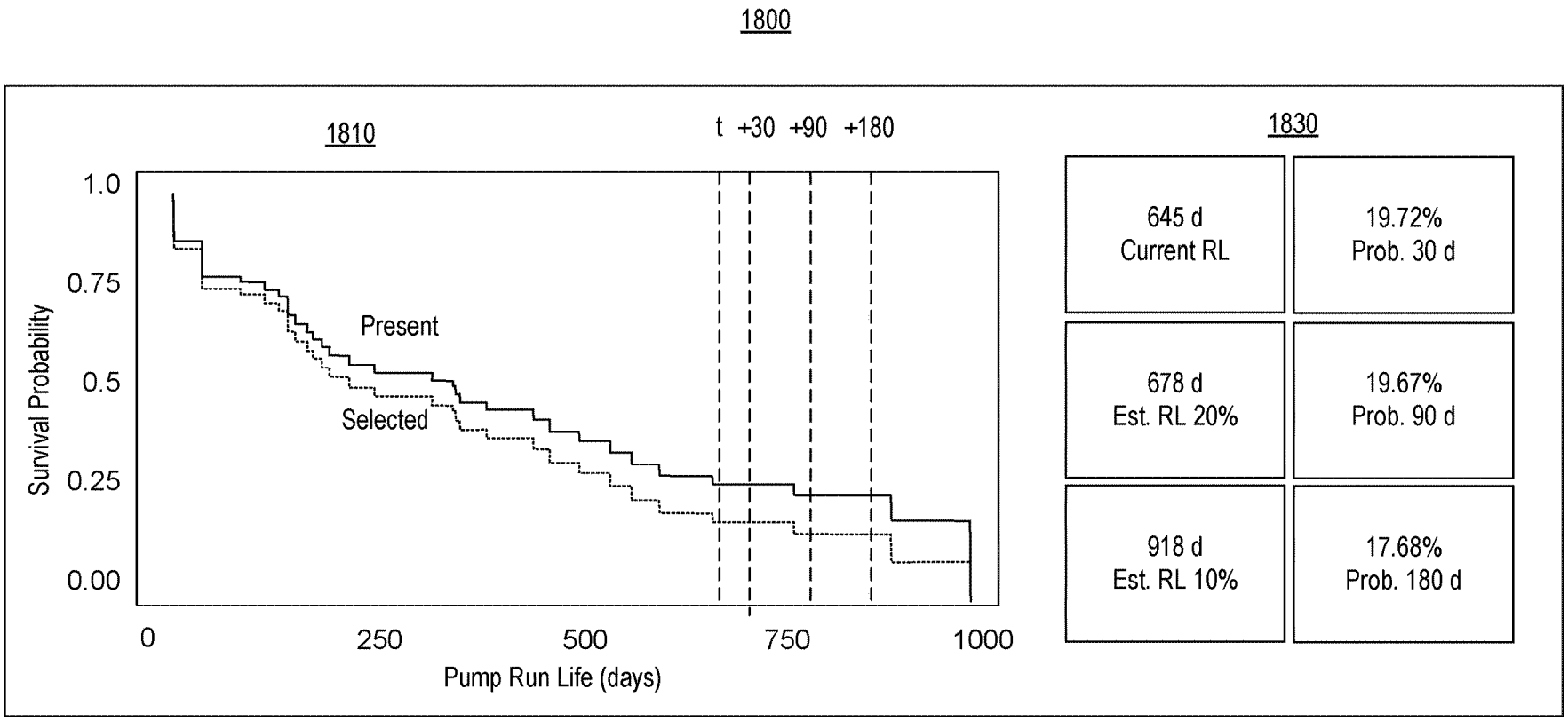
FIG. 18 illustrates an example of a graphical user interface.

FIG. 18 shows an example of a GUI 1800 for run life analytics, which may include one or more features for pump control. In the example of FIG. 18, the GUI 1800 includes a plot 1810 and graphics 1830. As shown, the plot 1810 includes a plot of survival probability versus pump run life in days, where the survival probability is predicted using a suitable survival model. In the example of FIG. 18, a present curve is shown along with a selected curve in the plot 1810, which can correspond to a selected "present" time (t) from which future times can be measured (e.g., 30 days, 90 days, 180 days, etc.). For example, an individual may select a scenario that differs from a present scenario to determine whether pump run life is acceptable for meeting one or more field and/or equipment goals. As to the graphics 1830, these show forecast statistics for current run life, estimated run life at 20 percent, estimated run life at 10 percent, survival probability at 30 days, survival probability at 90 days and survival probability at 180 days, which may be color coded, for example, becoming red or redder as probabilities decrease.

As explained, one or more GUIs can facilitate control of field equipment, including, for example, servicing, tripping, etc., which may help to improve field operations through reduced NPT, etc. As an example, a background process of a framework may be utilized to run various scenarios where an optimal scenario can be generated that may meet one or more field goals. In such an example, the optimal scenario (e.g., or a group of top ranked scenarios) may be presented for review and acceptance, as appropriate, to thereby alter operation of one or more pumps at one or more sites.

As explained, a framework can be local at a site and/or may be remote from a site and operatively coupled to equipment at the site. As explained, a framework can implement multiple models that can be driven by field data to assess and/or control operation of one or more pumps in the field.

As an example, a method can include receiving input that includes time series data from pump equipment at a wellsite, where the wellsite includes a wellbore in contact with a fluid reservoir; processing the input using a first trained machine learning model as an anomaly detector to generate output; and processing the input and the output using a second trained machine learning model to predict a survival function for the pump equipment. In such an example, the first trained machine learning model can be or include one or more of an autoencoder model, a clustering model and a tree model.

As an example, a first trained machine learning model can be trained using a normal behavior dataset for pump equipment where, for example, the first trained machine learning model can be trained using unsupervised learning.

As an example, a method can include processing input and output by computing differences between the input and the output where, for example, time series data, as input, include time series data for multiple channels where the differences can include differences for each of the multiple channels.

As an example, a survival function can be generated that indicates a probability of survival with respect to time for a number of days for pump equipment.

As an example, a method that utilizes a first and a second trained machine learning model can include, for the second trained machine learning model, training using output of the trained first machine learning model for a normal behavior and abnormal behavior dataset for pump equipment. In such an example, the second trained machine learning model can be trained using supervised learning. For example, consider using labels that indicate a time between a signature and a failure.

As an example, a trained machine learning model can include decision trees. For example, consider decision trees that are part of a random survival forest (RSF or RSF model). As an example, a trained machine learning model can include a time-dependent Cox model.

As an example, a method may be implemented using a computational device at a wellsite where the computational device receives input, processes the input to generate output and processes the input and the output to generate a survival function. In such an example, the computational device can include an application, an application programming interface and executable containerized data structures for a first trained machine learning model and a second trained machine learning model, where the application accesses the executable containerized data structures using the application programming interface.

As an example, pump equipment can include an electric submersible pump disposed in a wellbore and a surface control unit (e.g., a VSD unit, etc.) where at least a portion of time series data are received by a computing device from one or more sensors coupled to the electric submersible pump (e.g., consider a downhole gauge that includes multiple sensors).

As an example, input can correspond to a time window greater than 30 minutes where, for example, the input is updated according to a time interval, where the time interval is greater than 30 seconds and less than 30 minutes. In such an example, a survival function (e.g., a prediction) can be updated according to the time interval. As an example, a method can include utilizing a threshold to determine a day in the future for which pump equipment is likely to fail. As an example, a method can include computing a remaining useful life of pump equipment based at least in part on a predicted survival function.

As an example, a method can include adjusting one or more operational parameters of pump equipment based at least in part on a predicted survival function for the pump equipment. In such an example, the adjusting can aim to extend a remaining useful life of the pump equipment. As an example, a method can include adjusting one or more operational parameters of pump equipment based at least in part on a predicted survival function for the pump equipment and based at least in part on a digital twin of the pump equipment that predicts performance of the pump equipment responsive to implementation of the one or more operational parameters. For example, a digital twin can be a machine learning model that may be a dynamic model that learns using data that can include online, real-time data such that the digital twin can predict behavior of pump equipment. Such an approach may be run as a background process and utilized to generate one or more control strategies to meet one or more goals, which may be as to production of a resource, run life of pump equipment, reduction in NPT, etc. As explained, pump equipment may be operated (e.g., controlled) for purposes of scheduling maintenance, service, replacement, etc., in a manner that can help to reduce NPT. Such an approach may utilize one or more digital twins of one or more pumps (e.g., pump equipment, pump systems, etc.).

As an example, a system can include a processor; memory accessible to the processor; and processor-executable instructions stored in the memory to instruct the system to: receive input that includes time series data from pump equipment at a wellsite, where the wellsite includes a wellbore in contact with a fluid reservoir; process the input using a first trained machine learning model as an anomaly detector to generate output; and process the input and the output using a second trained machine learning model to predict a survival function for the pump equipment.

As an example, one or more computer-readable storage media can include processor-executable instructions to instruct a wellsite computing system to: receive input that includes time series data from pump equipment at a wellsite, where the wellsite includes a wellbore in contact with a fluid reservoir; process the input using a first trained machine learning model as an anomaly detector to generate output; and process the input and the output using a second trained machine learning model to predict a survival function for the pump equipment.

As an example, a computer program product can include one or more computer-readable storage media that can include processor-executable instructions to instruct a computing system to perform one or more methods and/or one or more portions of a method. Various example methods may be performed in various combinations.

Figure 19:
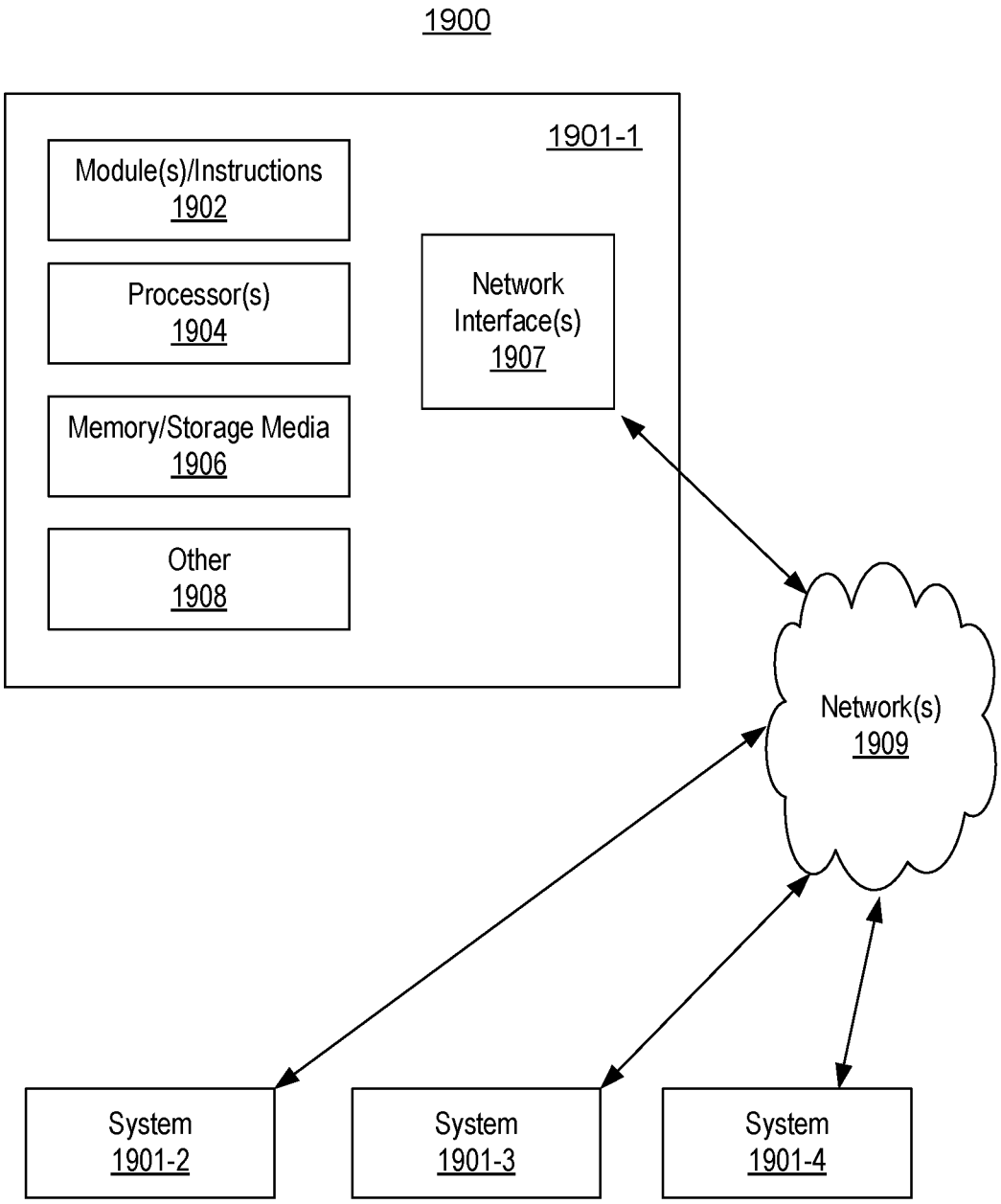
FIG. 19 illustrates examples of computer and network equipment.

In some embodiments, a method or methods may be executed by a computing system. FIG. 19 shows an example of a system 1900 that can include one or more computing systems 1901-1, 1901-2, 1901-3 and 1901-4, which may be operatively coupled via one or more networks 1909, which may include wired and/or wireless networks; noting that one or more other features 1908 can be included in the system 1900.

As an example, a system can include an individual computer system or an arrangement of distributed computer systems. In the example of FIG. 19, the computer system 1901-1 can include one or more modules 1902, which may be or include processor-executable instructions, for example, executable to perform various tasks (e.g., receiving information, requesting information, processing information, simulation, outputting information, etc.).

As an example, a module may be executed independently, or in coordination with, one or more processors 1904, which is (or are) operatively coupled to one or more storage media 1906 (e.g., via wire, wirelessly, etc.). As an example, one or more of the one or more processors 1904 can be operatively coupled to at least one of one or more network interface 1907. In such an example, the computer system 1901-1 can transmit and/or receive information, for example, via the one or more networks 1909 (e.g., consider one or more of the Internet, a private network, a cellular network, a satellite network, etc.).

As an example, the computer system 1901-1 may receive from and/or transmit information to one or more other devices, which may be or include, for example, one or more of the computer systems 1901-2, etc. A device may be located in a physical location that differs from that of the computer system 1901-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 1906 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

Figure 20:
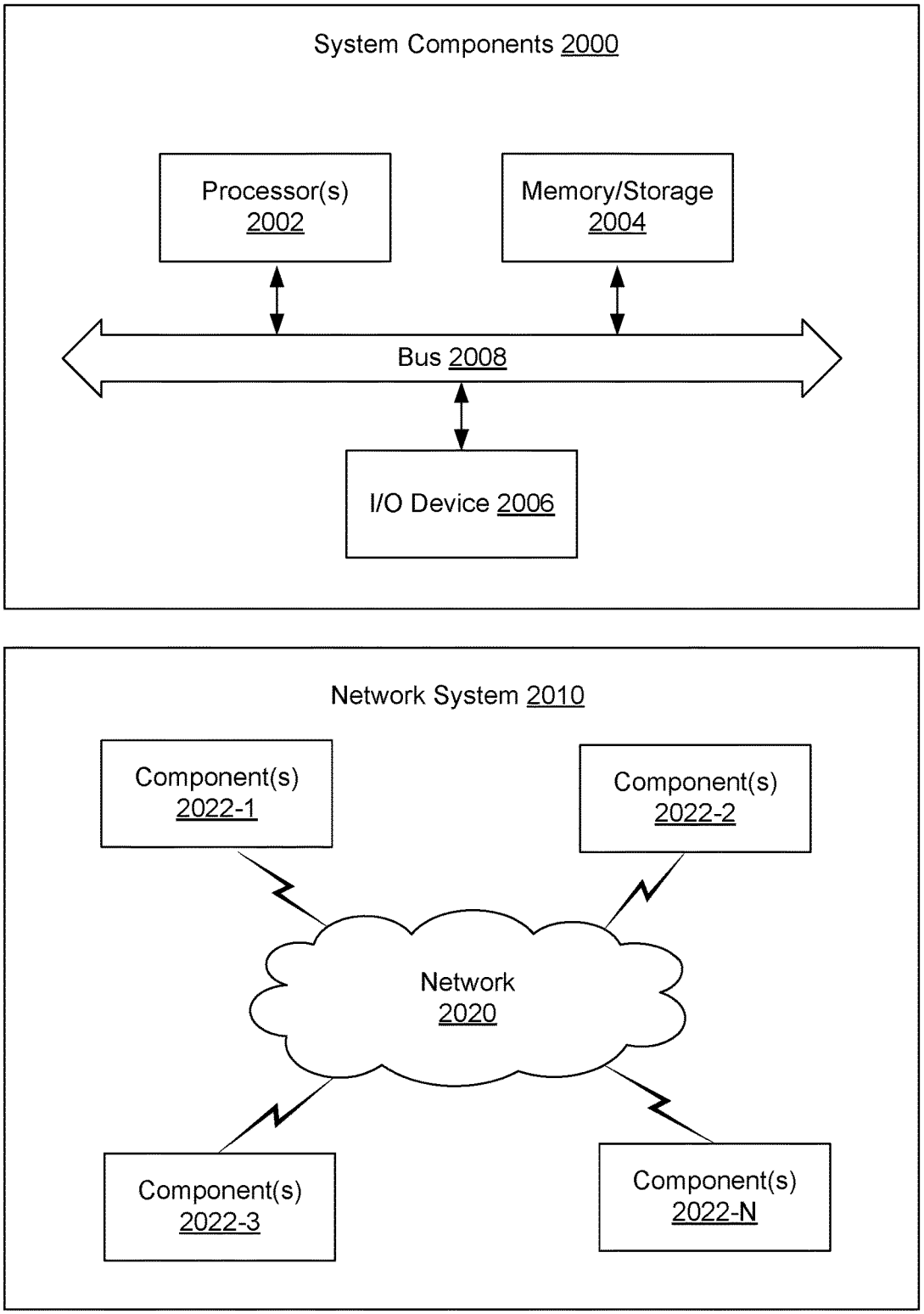
FIG. 20 illustrates example components of a system and a networked system.

FIG. 20 shows components of an example of a computing system 2000 and an example of a networked system 2010 with a network 2020. The system 2000 includes one or more processors 2002, memory and/or storage components 2004, one or more input and/or output devices 2006 and a bus 2008. In an example embodiment, instructions may be stored in one or more computer-readable media (e.g., memory/storage components 2004). Such instructions may be read by one or more processors (e.g., the processor(s) 2002) via a communication bus (e.g., the bus 2008), which may be wired or wireless. The one or more processors may execute such instructions to implement (wholly or in part) one or more attributes (e.g., as part of a method). A user may view output from and interact with a process via an I/O device (e.g., the device 2006). In an example embodiment, a computer-readable medium may be a storage component such as a physical memory storage device, for example, a chip, a chip on a package, a memory card, etc. (e.g., a computer-readable storage medium).

In an example embodiment, components may be distributed, such as in the network system 2010. The network system 2010 includes components 2022-1, 2022-2, 2022-3, . . . 2022-N. For example, the components 2022-1 may include the processor(s) 2002 while the component(s) 2022-3 may include memory accessible by the processor(s) 2002. Further, the component(s) 2022-2 may include an I/O device for display and optionally interaction with a method. The network 2020 may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

Although only a few example embodiments have been described in detail above, those skilled in the art will readily appreciate that many modifications are possible in the example embodiments. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

receiving input that comprises time series data from pump equipment at a wellsite, wherein the wellsite comprises a wellbore in contact with a fluid reservoir;

processing the input using a first trained machine learning model as an anomaly detector to generate output; and processing the input and the output using a second trained machine learning model to predict a survival function for the pump equipment.

2. The method of claim 1, wherein the first trained machine learning model comprises one or more of an autoencoder model, a clustering model, and a tree model.

3. The method of claim 1, wherein the first trained machine learning model is trained using a normal behavior dataset for the pump equipment.

4. The method of claim 3, wherein the first trained machine learning model is trained using unsupervised learning.

5. The method of claim 1, wherein processing the input and the output comprises computing differences between the input and the output.

6. The method of claim 5, wherein the time series data comprise time series data for multiple channels and wherein the differences comprise differences for each of the multiple channels.

7. The method of claim 1, wherein the survival function indicates a probability of survival with respect to time for a number of days.

8. The method of claim 1, wherein the second trained machine learning model is trained using the output of the trained first machine learning model for a normal behavior and abnormal behavior dataset for the pump equipment.

9. The method of claim 8, wherein the second trained machine learning model is trained using supervised learning.

10. The method of claim 1, wherein the second trained machine learning model comprises decision trees.

11. The method of claim 1, wherein the second trained machine learning model comprises a time-dependent Cox model.

12. The method of claim 1, wherein a computational device at the wellsite receives the input, processes the input to generate the output and processes the input and the output to generate the survival function.

13. The method of claim 1, wherein the pump equipment comprises an electric submersible pump disposed in the wellbore and a surface control unit and wherein at least a portion of the time series data are received from one or more sensors coupled to the electric submersible pump.

14. The method of claim 1, wherein the input corresponds to a time window greater than 30 minutes, wherein the input is updated according to a time interval, wherein the time interval is greater than 30 seconds and less than 30 minutes, and wherein the survival function is updated according to the time interval.

15. The method of claim 1, comprising adjusting one or more operational parameters of the pump equipment based at least in part on the predicted survival function for the pump equipment.

16. The method of claim 15, wherein the adjusting extends a remaining useful life of the pump equipment.

17. The method of claim 15, wherein the adjusting is based at least in part on a digital twin of the pump equipment that predicts performance of the pump equipment responsive to implementation of the one or more operational parameters.

18. The method of claim 1, comprising utilizing a remaining useful life of the pump equipment based at least in part on the survival function.

* * * * *